US009578435B2

(12) United States Patent
Herre et al.

(10) Patent No.: US 9,578,435 B2
(45) Date of Patent: Feb. 21, 2017

(54) APPARATUS AND METHOD FOR ENHANCED SPATIAL AUDIO OBJECT CODING

(71) Applicant: Fraunhofer-Gesellschaft zur Foerderung der angewandten Forschung e.V., Munich (DE)

(72) Inventors: Juergen Herre, Erlangen (DE); Adrian Murtaza, Craiova (RO); Jouni Paulus, Nuremberg (DE); Sascha Disch, Fuerth (DE); Harald Fuchs, Roettenbach (DE); Oliver Hellmuth, Budenhof (DE); Falko Ridderbusch, Augsburg (DE); Leon Terentiv, Erlangen (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 15/004,594

(22) Filed: Jan. 22, 2016

(65) Prior Publication Data

US 2016/0142846 A1 May 19, 2016

Related U.S. Application Data

(63) Continuation of application No. PCT/EP2014/065247, filed on Jul. 17, 2014.

(30) Foreign Application Priority Data

Jul. 22, 2013 (EP) ..... 13177357
Jul. 22, 2013 (EP) ..... 13177371

(Continued)

(51) Int. Cl.
*H04R 5/00* (2006.01)
*H04S 3/02* (2006.01)

(Continued)

(52) U.S. Cl.
CPC ..... *H04S 3/02* (2013.01); *G10L 19/008* (2013.01); *H04S 3/00* (2013.01); *H04S 3/006* (2013.01);

(Continued)

(58) Field of Classification Search
CPC ..... H04S 3/008; H04S 3/00; H04S 3/006; H04S 3/02; H04S 7/305; H04S 2400/01; H04S 2400/03; H04S 2400/11; H04S 2400/13; H04S 2420/03; G10L 19/008

(Continued)

(56) References Cited

U.S. PATENT DOCUMENTS 2,605,361 A 7/1952 Cutler
8,255,212 B2 8/2012 Villemoes (Continued)

FOREIGN PATENT DOCUMENTS

CN 102016982 A 4/2011
TW 200813981 A 3/2008

(Continued)

OTHER PUBLICATIONS

"Extensible Markup Language (XML) 1.0 (Fifth Edition)", World Wide Web Consortium [online], http://www.w3.org/TR/2008/REC-xml-20081126/ (printout of internet site on Jun. 23, 2016), Nov. 26, 2008, 35 Pages.

(Continued)

*Primary Examiner* — Paul S Kim
(74) *Attorney, Agent, or Firm* — Michael A. Glenn; Perkins Coie LLP

(57) ABSTRACT

An apparatus for generating one or more audio output channels is provided. The apparatus includes a parameter processor for calculating mixing information and a downmix processor for generating the one or more audio output channels. The downmix processor is configured to receive an audio transport signal including one or more audio transport channels. One or more audio channel signals are mixed within the audio transport signal, and one or more audio object signals are mixed within the audio transport signal, and wherein the number of the one or more audio (Continued)

(ENCODER)

transport channels is smaller than the number of the one or more audio channel signals plus the number of the one or more audio object signals. The parameter processor is configured to receive downmix information indicating information on how the one or more audio channel signals and the one or more audio object signals are mixed.

18 Claims, 10 Drawing Sheets

(30) Foreign Application Priority Data

Jul. 22, 2013 (EP) ..... 13177378
Oct. 18, 2013 (EP) ..... 13189290

(51) Int. Cl.
*G10L 19/008* (2013.01)
*H04S 3/00* (2006.01)
*H04S 7/00* (2006.01)

(52) U.S. Cl.
CPC ..... *H04S 3/008* (2013.01); *H04S 7/305* (2013.01); *H04S 2400/01* (2013.01); *H04S 2400/03* (2013.01); *H04S 2400/11* (2013.01); *H04S 2400/13* (2013.01); *H04S 2420/03* (2013.01)

(58) Field of Classification Search
USPC ..... 381/23, 22, 19, 20
See application file for complete search history.

(56) References Cited

U.S. PATENT DOCUMENTS

| | | | | |
|---|---|---|---|---|
| 8,504,184 | B2 | 8/2013 | Ishikawa et al. | |
| 8,798,776 | B2 | 8/2014 | Schildbach et al. | |
| 8,824,688 | B2 | 9/2014 | Schreiner et al. | |
| 2004/0028125 | A1 | 2/2004 | Sato | |
| 2006/0136229 | A1 | 6/2006 | Kjoerling et al. | |
| 2009/0006103 | A1 | 1/2009 | Koishida et al. | |
| 2009/0326958 | A1* | 12/2009 | Kim | G10L 19/008 704/500 |
| 2010/0017195 | A1 | 1/2010 | Villemoes | |
| 2010/0083344 | A1 | 4/2010 | Schildbach et al. | |
| 2010/0094631 | A1 | 4/2010 | Engdegard et al. | |
| 2010/0174548 | A1 | 7/2010 | Beack et al. | |
| 2010/0324915 | A1 | 12/2010 | Seo et al. | |
| 2011/0022402 | A1 | 1/2011 | Engdegard et al. | |
| 2011/0029113 | A1 | 2/2011 | Ishikawa et al. | |
| 2012/0183162 | A1 | 7/2012 | Chabanne et al. | |
| 2012/0308049 | A1 | 12/2012 | Schreiner et al. | |
| 2013/0013321 | A1 | 1/2013 | Oh et al. | |

FOREIGN PATENT DOCUMENTS

| | | | |
|---|---|---|---|
| TW | 200828269 | A | 7/2008 |
| TW | 201010450 | A | 3/2010 |
| TW | 201027517 | A | 7/2010 |
| WO | 2012/125855 | A1 | 9/2012 |
| WO | 2013/006325 | A1 | 1/2013 |
| WO | 2013/006330 | A2 | 1/2013 |
| WO | 2013/006338 | A2 | 1/2013 |
| WO | 2013/064957 | A1 | 5/2013 |

OTHER PUBLICATIONS

"International Standard ISO/IEC 14772-1:1997—The Virtual Reality Modeling Language (VRML), Part 1: Functional specification and UTF-8 encoding", http://tecfa.unige.ch/guides/vrml/vrml97/spec/, 1997, 2 Pages.

"Synchronized Multimedia Integration Language (SMIL 3.0)", URL: http://www.w3.org/TR/2008/REC-SMIL3-20081201/, Dec. 2008, 200 Pages.

International Telecommunication Union; "Information Technology—Generic Coding of Moving Pictures and associated Audio Information: Systems"; ITU-T Rec. H.220.0 (May 2012), 234 pages.

Chen, C. Y. et al., "Dynamic Light Scattering of poly(vinyl alcohol)-borax aqueous solution near overlap concentration", Polymer Papers, vol. 38, No. 9., Elsevier Science Ltd., XP4058593A, 1997, pp. 2019-2025.

Douglas, D. et al., "Algorithms for the Reduction of the Number of Points Required to Represent a Digitized Line or its Caricature", The Canadian Cartographer, vol. 10, No. 2, Dec. 1973, pp. 112-122.

Engdegard, J. et al., "Spatial Audio Object Coding (SAOC)—The Upcoming MPEG Standard on Parametric Object Based Audio Coding", Audio Engineering Society, 124th AES Convention, Paper 7377, May 17-20, 2008, pp. 1-15.

Geier, M. et al., "Object-based Audio Reproduction and the Audio Scene Description Format", Organised Sound, vol. 15, No. 3, Dec. 2010, pp. 219-227.

Helmrich, C.R. et al., "Efficient transform coding of two-channel audio signals by means of complex-valued stereo prediction", Acoustics, Speech and Signal Processing (ICASSP), 2011, IEEE International Conference On, IEEE, XP032000783, DOI: 10.1109/ICASSP.2011.5946449, ISBN: 978-1-4577-0538-0, May 22, 2011, pp. 497-500.

Herre, J. et al., "The Reference Model Architecture for MPEG Spatial Audio Coding", Audio Engineering Society, AES 118th Convention, Convention paper 6447, Barcelona, Spain, May 28-31, 2005, 13 pages.

Herre, J. et al., "From SAC to SAOC—Recent Developments in Parametric Coding of Spatial Audio", Fraunhofer Institute for Integrated Circuits, Illusions in Sound, AES 22nd UK Conference 2007, Apr. 2007, pp. 12-1 through 12-8.

ISO/IEC 23003-2, "MPEG audio technologies—Part 2: Spatial Audio Object Coding (SAOC)", ISO/IEC JTC1/SC29/WG11 (MPEG) International Standard 23003-2, Oct. 1, 2010, pp. 1-130.

ISO/IEC 14496-3, "Information technology—Coding of audio-visual objects/ Part 3: Audio", ISO/IEC 2009, 2009, 1416 pages.

ISO/IEC 23003-3, "Information Technology—MPEG audio technologies—Part 3: Unified Speech and Audio Coding", International Standard, ISO/IEC FDIS 23003-3, 2011, 286 pages.

Neuendorf, M. et al., "MPEG Unified Speech and Audio Coding—The ISO/MPEG Standard for High-Efficiency Audio Coding of all Content Types", Audio Engineering Society Convention Paper 8654, Presented at the 132nd Convention, Budapest, Hungary, Apr. 26-29, 2012, pp. 1-22.

Peters, N. et al., "SpatDIF: Principles, Specification, and Examples", Proceedings of the 9th Sound and Music Computing Conference, Copenhagen, Denmark, Jul. 11-14, 2012, pp. SMC2012-500 through SMC2012-505.

Peters, N. et al., "The Spatial Sound Description Interchange Format: Principles, Specification, and Examples", Computer Music Journal, 37:1, XP055137982, DOI: 10.1162/COMJ_a_00167, Retrieved from the Internet: URL:http://www.mitpressjournals.org/doi/pdfplus/10.1162/COMJ_a_00167 [retrieved on Sep. 3, 2014], May 3, 2013, pp. 11-22.

Pulkki, V., "Virtual Sound Source Positioning Using Vector Base Amplitude Panning", Journal of Audio Eng. Soc. vol. 45, No. 6., Jun. 1997, pp. 456-464.

Ramer, U., "An Iterative Procedure for the Polygonal Approximation of Plane Curves", Computer Graphics and Image, vol. 1, 1972, pp. 244-256.

Schmidt, J. et al., "New and Advanced Features for Audio Presentation in the MPEG-4 Standard", Audio Engineering Society, Convention Paper 6058, 116th AES Convention, Berlin, Germany, May 8-11, 2004, pp. 1-13.

Sporer, T., "Codierung räumlicher Audiosignale mit leichtgewichtigen Audio-Objekten" (Encoding of Spatial Audio Signals with Lightweight Audio Objects), Proc. Annual Meeting of the German Audiological Society (DGA), Erlangen, Germany, Mar. 2012, 22 Pages.

(56) References Cited

OTHER PUBLICATIONS

Valin, J. M. et al., "Defintion of the Opus Audio Codec", Internet Engineering Task Force (IETF), Sep. 2012, pp. 1-326.
Wright, M. et al., "Open SoundControl: A New Protocol for Communicating with Sound Synthesizers", Proceedings of the 1997 International Computer Music Conference, vol. 2013, No. 8, 1997, 5 pages.

* cited by examiner (ENCODER)

(DECODER)

(ENCODER)

(DECODER)

(ENCODER)

(DECODER)

APPARATUS AND METHOD FOR ENHANCED SPATIAL AUDIO OBJECT CODING

CROSS-REFERENCE TO RELATED APPLICATIONS

This application is a continuation of copending International Application No. PCT/EP2014/065427, filed Jul. 17, 2014, which claims priority from European Applications Nos. EP 13177357, filed Jul. 22, 2013, EP 13177371, filed Jul. 22, 2013, EP 13177378, filed Jul. 22, 2013, and EP 13189290, filed Oct. 18, 2013, which are each incorporated herein in its entirety by this reference thereto.

The present invention is related to audio encoding/decoding, in particular, to spatial audio coding and spatial audio object coding, and, more particularly, to an apparatus and method for enhanced Spatial Audio Object Coding.

BACKGROUND OF THE INVENTION

Spatial audio coding tools are well-known in the art and are, for example, standardized in the MPEG-surround standard. Spatial audio coding starts from original input channels such as five or seven channels which are identified by their placement in a reproduction setup, i.e., a left channel, a center channel, a right channel, a left surround channel, a right surround channel and a low frequency enhancement channel. A spatial audio encoder typically derives one or more downmix channels from the original channels and, additionally, derives parametric data relating to spatial cues such as inter-channel level differences in the channel coherence values, inter-channel phase differences, inter-channel time differences, etc. The one or more downmix channels are transmitted together with the parametric side information indicating the spatial cues to a spatial audio decoder which decodes the downmix channel and the associated parametric data in order to finally obtain output channels which are an approximated version of the original input channels. The placement of the channels in the output setup is typically fixed and is, for example, a 5.1 format, a 7.1 format, etc.

Such channel-based audio formats are widely used for storing or transmitting multi-channel audio content where each channel relates to a specific loudspeaker at a given position. A faithful reproduction of these kind of formats involves a loudspeaker setup where the speakers are placed at the same positions as the speakers that were used during the production of the audio signals. While increasing the number of loudspeakers improves the reproduction of truly immersive 3D audio scenes, it becomes more and more difficult to fulfill this requirement—especially in a domestic environment like a living room.

The necessity of having a specific loudspeaker setup can be overcome by an object-based approach where the loudspeaker signals are rendered specifically for the playback setup.

For example, spatial audio object coding tools are well-known in the art and are standardized in the MPEG SAOC standard (SAOC=spatial audio object coding). In contrast to spatial audio coding starting from original channels, spatial audio object coding starts from audio objects which are not automatically dedicated for a certain rendering reproduction setup. Instead, the placement of the audio objects in the reproduction scene is flexible and can be determined by the user by inputting certain rendering information into a spatial audio object coding decoder. Alternatively or additionally, rendering information, i.e., information at which position in the reproduction setup a certain audio object is to be placed typically over time can be transmitted as additional side information or metadata. In order to obtain a certain data compression, a number of audio objects are encoded by an SAOC encoder which calculates, from the input objects, one or more transport channels by downmixing the objects in accordance with certain downmixing information. Furthermore, the SAOC encoder calculates parametric side information representing inter-object cues such as object level differences (OLD), object coherence values, etc. As in SAC (SAC=Spatial Audio Coding), the inter object parametric data is calculated for parameter time/frequency tiles, i.e., for a certain frame of the audio signal comprising, for example, 1024 or 2048 samples, 28, 20, 14 or 10, etc., processing bands are considered so that, in the end, parametric data exists for each frame and each processing band. As an example, when an audio piece has 20 frames and when each frame is subdivided into 28 processing bands, then the number of parameter time/frequency tiles is 560.

In an object-based approach, the sound field is described by discrete audio objects. This involves object metadata that describes among others the time-variant position of each sound source in 3D space.

A first metadata coding concept in conventional technology is the spatial sound description interchange format (SpatDIF), an audio scene description format which is still under development [M1]. It is designed as an interchange format for object-based sound scenes and does not provide any compression method for object trajectories. SpatDIF uses the text-based Open Sound Control (OSC) format to structure the object metadata [M2]. A simple text-based representation, however, is not an option for the compressed transmission of object trajectories.

Another metadata concept in conventional technology is the Audio Scene Description Format (ASDF) [M3], a text-based solution that has the same disadvantage. The data is structured by an extension of the Synchronized Multimedia Integration Language (SMIL) which is a sub set of the Extensible Markup Language (XML) [M4], [M5].

A further metadata concept in conventional technology is the audio binary format for scenes (AudioBIFS), a binary format that is part of the MPEG-4 specification [M6], [M7]. It is closely related to the XML-based Virtual Reality Modeling Language (VRML) which was developed for the description of audio-visual 3D scenes and interactive virtual reality applications [M8]. The complex AudioBIFS specification uses scene graphs to specify routes of object movements. A major disadvantage of AudioBIFS is that is not designed for real-time operation where a limited system delay and random access to the data stream are a requirement. Furthermore, the encoding of the object positions does not exploit the limited localization performance of human listeners. For a fixed listener position within the audio-visual scene, the object data can be quantized with a much lower number of bits [M9]. Hence, the encoding of the object metadata that is applied in AudioBIFS is not efficient with regard to data compression.

SUMMARY

According to an embodiment, an apparatus for generating one or more audio output channels may have: a parameter processor for calculating mixing information, and a downmix processor for generating the one or more audio output channels, wherein the downmix processor is configured to receive a data stream including audio transport channels of an audio transport signal, wherein one or more audio channel signals are mixed within the audio transport signal, wherein one or more audio object signals are mixed within the audio transport signal, and wherein the number of the audio transport channels is smaller than the number of the one or more audio channel signals plus the number of the one or more audio object signals, wherein the parameter processor is configured to receive downmix information indicating information on how the one or more audio channel signals and the one or more audio object signals are mixed within the audio transport channels, and wherein the parameter processor is configured to receive covariance information, and wherein the parameter processor is configured to calculate the mixing information depending on the downmix information and depending on the covariance information, and wherein the downmix processor is configured to generate the one or more audio output channels from the audio transport signal depending on the mixing information, wherein the covariance information indicates a level difference information for at least one of the one or more audio channel signals and further indicates a level difference information for at least one of the one or more audio object signals, and wherein the covariance information does not indicate correlation information for any pair of one of the one or more audio channel signals and one of the one or more audio object signals, wherein the one or more audio channel signals are mixed within a first group of one or more of the audio transport channels, wherein the one or more audio object signals are mixed within a second group of one or more of the audio transport channels, wherein each audio transport channel of the first group is not included in the second group, and wherein each audio transport channel of the second group is not included in the first group, and wherein the downmix information includes first downmix subinformation indicating information on how the one or more audio channel signals are mixed within the first group of the audio transport channels, and wherein the downmix information includes second downmix subinformation indicating information on how the one or more audio object signals are mixed within the second group of the one or more audio transport channels, wherein the parameter processor is configured to calculate the mixing information depending on the first downmix subinformation, depending on the second downmix subinformation and depending on the covariance information, wherein the downmix processor is configured to generate the one or more audio output signals from the first group of audio transport channels and from the second group of audio transport channels depending on the mixing information, wherein the downmix processor is configured to receive a first channel count number indicating the number of the audio transport channels of the first group of audio transport channels, and wherein the downmix processor is configured to receive a second channel count number indicating the number of the audio transport channels of the second group of audio transport channels, and wherein the downmix processor is configured to identify whether an audio transport channel within the data stream belongs to the first group or to the second group depending on the first channel count number or depending on the second channel count number, or depending on the first channel count number and the second channel count number.

According to another embodiment, an apparatus for generating an audio transport signal including audio transport channels may have: a channel/object mixer for generating the audio transport channels of the audio transport signal, and an output interface, wherein the channel/object mixer is configured to generate the audio transport signal including the audio transport channels by mixing one or more audio channel signals and one or more audio object signals within the audio transport signal depending on downmix information indicating information on how the one or more audio channel signals and the one or more audio object signals have to be mixed within the audio transport channels, wherein the number of the audio transport channels is smaller than the number of the one or more audio channel signals plus the number of the one or more audio object signals, wherein the output interface is configured to output the audio transport signal, the downmix information and covariance information, wherein the covariance information indicates a level difference information for at least one of the one or more audio channel signals and further indicates a level difference information for at least one of the one or more audio object signals, and wherein the covariance information does not indicate correlation information for any pair of one of the one or more audio channel signals and one of the one or more audio object signals, wherein the apparatus is configured to mix the one or more audio channel signals within a first group of one or more of the audio transport channels, wherein the apparatus is configured to mix the one or more audio object signals within a second group of one or more of the audio transport channels, wherein each audio transport channel of the first group is not included in the second group, and wherein each audio transport channel of the second group is not included in the first group, and wherein the downmix information includes first downmix subinformation indicating information on how the one or more audio channel signals are mixed within the first group of the audio transport channels, and wherein the downmix information includes second downmix subinformation indicating information on how the one or more audio object signals are mixed within the second group of the audio transport channels, wherein the apparatus is configured to output a first channel count number indicating the number of the audio transport channels of the first group of audio transport channels, and wherein the apparatus is configured to output a second channel count number indicating the number of the audio transport channels of the second group of audio transport channels.

According to another embodiment, a system may have: an apparatus for generating an audio transport signal including audio transport channels, which apparatus may have: a channel/object mixer for generating the audio transport channels of the audio transport signal, and an output interface, wherein the channel/object mixer is configured to generate the audio transport signal including the audio transport channels by mixing one or more audio channel signals and one or more audio object signals within the audio transport signal depending on downmix information indicating information on how the one or more audio channel signals and the one or more audio object signals have to be mixed within the audio transport channels, wherein the number of the audio transport channels is smaller than the number of the one or more audio channel signals plus the number of the one or more audio object signals, wherein the output interface is configured to output the audio transport signal, the downmix information and covariance information, wherein the covariance information indicates a level difference information for at least one of the one or more audio channel signals and further indicates a level difference information for at least one of the one or more audio object signals, and wherein the covariance information does not indicate correlation information for any pair of one of the one or more audio channel signals and one of the one or more audio object signals, wherein the apparatus is configured to mix the one or more audio channel signals within a first group of one or more of the audio transport channels, wherein the apparatus is configured to mix the one or more audio object signals within a second group of one or more of the audio transport channels, wherein each audio transport channel of the first group is not included in the second group, and wherein each audio transport channel of the second group is not included in the first group, and wherein the downmix information includes first downmix subinformation indicating information on how the one or more audio channel signals are mixed within the first group of the audio transport channels, and wherein the downmix information includes second downmix subinformation indicating information on how the one or more audio object signals are mixed within the second group of the audio transport channels, wherein the apparatus is configured to output a first channel count number indicating the number of the audio transport channels of the first group of audio transport channels, and wherein the apparatus is configured to output a second channel count number indicating the number of the audio transport channels of the second group of audio transport channels, and an apparatus for generating one or more audio output channels, which apparatus may have: a parameter processor for calculating mixing information, and a downmix processor for generating the one or more audio output channels, wherein the downmix processor is configured to receive a data stream including audio transport channels of an audio transport signal, wherein one or more audio channel signals are mixed within the audio transport signal, wherein one or more audio object signals are mixed within the audio transport signal, and wherein the number of the audio transport channels is smaller than the number of the one or more audio channel signals plus the number of the one or more audio object signals, wherein the parameter processor is configured to receive downmix information indicating information on how the one or more audio channel signals and the one or more audio object signals are mixed within the audio transport channels, and wherein the parameter processor is configured to receive covariance information, and wherein the parameter processor is configured to calculate the mixing information depending on the downmix information and depending on the covariance information, and wherein the downmix processor is configured to generate the one or more audio output channels from the audio transport signal depending on the mixing information, wherein the covariance information indicates a level difference information for at least one of the one or more audio channel signals and further indicates a level difference information for at least one of the one or more audio object signals, and wherein the covariance information does not indicate correlation information for any pair of one of the one or more audio channel signals and one of the one or more audio object signals, wherein the one or more audio channel signals are mixed within a first group of one or more of the audio transport channels, wherein the one or more audio object signals are mixed within a second group of one or more of the audio transport channels, wherein each audio transport channel of the first group is not included in the second group, and wherein each audio transport channel of the second group is not included in the first group, and wherein the downmix information includes first downmix subinformation indicating information on how the one or more audio channel signals are mixed within the first group of the audio transport channels, and wherein the downmix information includes second downmix subinformation indicating information on how the one or more audio object signals are mixed within the second group of the one or more audio transport channels, wherein the parameter processor is configured to calculate the mixing information depending on the first downmix subinformation, depending on the second downmix subinformation and depending on the covariance information, wherein the downmix processor is configured to generate the one or more audio output signals from the first group of audio transport channels and from the second group of audio transport channels depending on the mixing information, wherein the downmix processor is configured to receive a first channel count number indicating the number of the audio transport channels of the first group of audio transport channels, and wherein the downmix processor is configured to receive a second channel count number indicating the number of the audio transport channels of the second group of audio transport channels, and wherein the downmix processor is configured to identify whether an audio transport channel within the data stream belongs to the first group or to the second group depending on the first channel count number or depending on the second channel count number, or depending on the first channel count number and the second channel count number, wherein the apparatus for generating one or more audio output channels is configured to receive the audio transport signal, downmix information and covariance information from the an apparatus for generating an audio transport signal, and wherein the apparatus for generating one or more audio output channels is configured to generate the one or more audio output channels from the audio transport signal depending on the downmix information and depending on the covariance information.

According to another embodiment, a method for generating one or more audio output channels may have the steps of: receiving a data stream including audio transport channels of an audio transport signal, wherein one or more audio channel signals are mixed within the audio transport signal, wherein one or more audio object signals are mixed within the audio transport signal, and wherein the number of the audio transport channels is smaller than the number of the one or more audio channel signals plus the number of the one or more audio object signals, receiving downmix information indicating information on how the one or more audio channel signals and the one or more audio object signals are mixed within the audio transport channels, receiving covariance information, calculating mixing information depending on the downmix information and depending on the covariance information, and generating the one or more audio output channels, generating the one or more audio output channels from the audio transport signal depending on the mixing information, wherein the covariance information indicates a level difference information for at least one of the one or more audio channel signals and further indicates a level difference information for at least one of the one or more audio object signals, and wherein the covariance information does not indicate correlation information for any pair of one of the one or more audio channel signals and one of the one or more audio object signals, wherein the one or more audio channel signals are mixed within a first group of one or more of the audio transport channels, wherein the one or more audio object signals are mixed within a second group of one or more of the audio transport channels, wherein each audio transport channel of the first group is not included in the second group, and wherein each audio transport channel of the second group is not included in the first group, and wherein the downmix information includes first downmix subinformation indicating information on how the one or more audio channel signals are mixed within the first group of the audio transport channels, and wherein the downmix information includes second downmix subinformation indicating information on how the one or more audio object signals are mixed within the second group of the audio transport channels, wherein the mixing information is calculated depending on the first downmix subinformation, depending on the second downmix subinformation and depending on the covariance information, wherein the one or more audio output signals are generated from the first group of audio transport channels and from the second group of audio transport channels depending on the mixing information, wherein the method further includes receiving a first channel count number indicating the number of the audio transport channels of the first group of audio transport channels, and wherein the method further includes receiving a second channel count number indicating the number of the audio transport channels of the second group of audio transport channels, and wherein the method further includes identifying whether an audio transport channel within the data stream belongs to the first group or to the second group depending on the first channel count number or depending on the second channel count number, or depending on the first channel count number and the second channel count number.

According to another embodiment, a method for generating an audio transport signal including audio transport channels may have the steps of: generating the audio transport signal including the audio transport channels by mixing one or more audio channel signals and one or more audio object signals within the audio transport signal depending on downmix information indicating information on how the one or more audio channel signals and the one or more audio object signals have to be mixed within the audio transport channels, wherein the number of the audio transport channels is smaller than the number of the one or more audio channel signals plus the number of the one or more audio object signals, and outputting the audio transport signal, the downmix information and covariance information, wherein the covariance information indicates a level difference information for at least one of the one or more audio channel signals and further indicates a level difference information for at least one of the one or more audio object signals, and wherein the covariance information does not indicate correlation information for any pair of one of the one or more audio channel signals and one of the one or more audio object signals, wherein the one or more audio channel signals are mixed within a first group of one or more of the audio transport channels, wherein the one or more audio object signals are mixed within a second group of one or more of the audio transport channels, wherein each audio transport channel of the first group is not included in the second group, and wherein each audio transport channel of the second group is not included in the first group, and wherein the downmix information includes first downmix subinformation indicating information on how the one or more audio channel signals are mixed within the first group of the audio transport channels, and wherein the downmix information includes second downmix subinformation indicating information on how the one or more audio object signals are mixed within the second group of the audio transport channels, and wherein the method further includes outputting a first channel count number indicating the number of the audio transport channels of the first group of audio transport channels, and wherein the method further includes outputting a second channel count number indicating the number of the audio transport channels of the second group of audio transport channels.

According to another embodiment, a non-transitory digital storage medium may have computer-readable code stored thereon to perform the inventive method when said storage medium is run by a computer or signal processor.

An apparatus for generating one or more audio output channels is provided. The apparatus comprises a parameter processor for calculating mixing information and a downmix processor for generating the one or more audio output channels. The downmix processor is configured to receive an audio transport signal comprising one or more audio transport channels. One or more audio channel signals are mixed within the audio transport signal, and one or more audio object signals are mixed within the audio transport signal, and wherein the number of the one or more audio transport channels is smaller than the number of the one or more audio channel signals plus the number of the one or more audio object signals. The parameter processor is configured to receive downmix information indicating information on how the one or more audio channel signals and the one or more audio object signals are mixed within the one or more audio transport channels, and wherein the parameter processor is configured to receive covariance information. Moreover, the parameter processor is configured to calculate the mixing information depending on the downmix information and depending on the covariance information. The downmix processor is configured to generate the one or more audio output channels from the audio transport signal depending on the mixing information. The covariance information indicates a level difference information for at least one of the one or more audio channel signals and further indicates a level difference information for at least one of the one or more audio object signals. However, the covariance information does not indicate correlation information for any pair of one of the one or more audio channel signals and one of the one or more audio object signals.

Moreover, an apparatus for generating an audio transport signal comprising one or more audio transport channels is provided. The apparatus comprises a channel/object mixer for generating the one or more audio transport channels of the audio transport signal, and an output interface. The channel/object mixer is configured to generate the audio transport signal comprising the one or more audio transport channels by mixing one or more audio channel signals and one or more audio object signals within the audio transport signal depending on downmix information indicating information on how the one or more audio channel signals and the one or more audio object signals have to be mixed within the one or more audio transport channels, wherein the number of the one or more audio transport channels is smaller than the number of the one or more audio channel signals plus the number of the one or more audio object signals. The output interface is configured to output the audio transport signal, the downmix information and covariance information. The covariance information indicates a level difference information for at least one of the one or more audio channel signals and further indicates a level difference information for at least one of the one or more audio object signals. However, the covariance information does not indicate correlation information for any pair of one of the one or more audio channel signals and one of the one or more audio object signals.

Furthermore, a system is provided. The system comprises an apparatus for generating an audio transport signal as described above and an apparatus for generating one or more audio output channels as described above. The apparatus for generating the one or more audio output channels is configured to receive the audio transport signal, downmix information and covariance information from the apparatus for generating the audio transport signal. Moreover, the apparatus for generating the audio output channels is configured to generate the one or more audio output channels depending from the audio transport signal depending on the downmix information and depending on the covariance information.

Moreover, a method for generating one or more audio output channels is provided. The method comprises:

Receiving an audio transport signal comprising one or more audio transport channels, wherein one or more audio channel signals are mixed within the audio transport signal, wherein one or more audio object signals are mixed within the audio transport signal, and wherein the number of the one or more audio transport channels is smaller than the number of the one or more audio channel signals plus the number of the one or more audio object signals.

Receiving downmix information indicating information on how the one or more audio channel signals and the one or more audio object signals are mixed within the one or more audio transport channels.

Receiving covariance information.

Calculating mixing information depending on the downmix information and depending on the covariance information. And:

Generating the one or more audio output channels.

Generating the one or more audio output channels from the audio transport signal depending on the mixing information. The covariance information indicates a level difference information for at least one of the one or more audio channel signals and further indicates a level difference information for at least one of the one or more audio object signals. However, the covariance information does not indicate correlation information for any pair of one of the one or more audio channel signals and one of the one or more audio object signals.

Furthermore, a method for generating an audio transport signal comprising one or more audio transport channels. The method comprises:

Generating the audio transport signal comprising the one or more audio transport channels by mixing one or more audio channel signals and one or more audio object signals within the audio transport signal depending on downmix information indicating information on how the one or more audio channel signals and the one or more audio object signals have to be mixed within the one or more audio transport channels, wherein the number of the one or more audio transport channels is smaller than the number of the one or more audio channel signals plus the number of the one or more audio object signals. And:

Outputting the audio transport signal, the downmix information and covariance information.

The covariance information indicates a level difference information for at least one of the one or more audio channel signals and further indicates a level difference information for at least one of the one or more audio object signals. However, the covariance information does not indicate correlation information for any pair of one of the one or more audio channel signals and one of the one or more audio object signals.

Moreover, a computer program for implementing the above-described method when being executed on a computer or signal processor is provided.

BRIEF DESCRIPTION OF THE DRAWINGS

Embodiments of the present invention will be detailed subsequently referring to the appended drawings, in which.

DETAILED DESCRIPTION OF THE INVENTION

Before describing advantageous embodiments of the present invention in detail, the new 3D Audio Codec System is described.

In conventional technology, no flexible technology exists combining channel coding on the one hand and object coding on the other hand so that acceptable audio qualities at low bit rates are obtained.

This limitation is overcome by the new 3D Audio Codec System.

Before describing advantageous embodiments in detail, the new 3D Audio Codec System is described.

Figure 4:
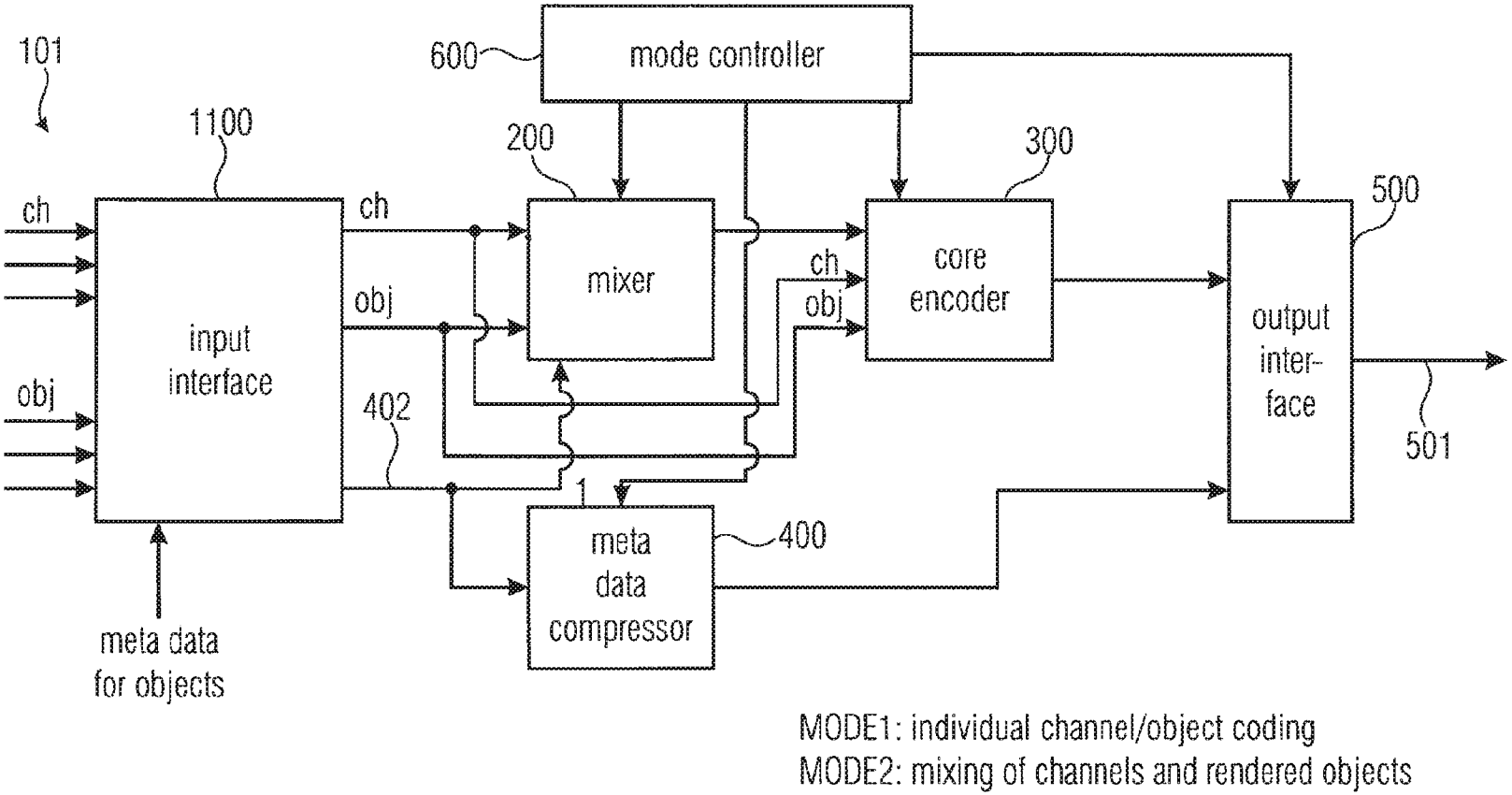
FIG. 4 illustrates a first embodiment of a 3D audio encoder.

FIG. 4 illustrates a 3D audio encoder in accordance with an embodiment of the present invention. The 3D audio encoder is configured for encoding audio input data 101 to obtain audio output data 501. The 3D audio encoder comprises an input interface for receiving a plurality of audio channels indicated by CH and a plurality of audio objects indicated by OBJ. Furthermore, as illustrated in FIG. 4, the input interface 1100 additionally receives metadata related to one or more of the plurality of audio objects OBJ. Furthermore, the 3D audio encoder comprises a mixer 200 for mixing the plurality of objects and the plurality of channels to obtain a plurality of pre-mixed channels, wherein each pre-mixed channel comprises audio data of a channel and audio data of at least one object.

Furthermore, the 3D audio encoder comprises a core encoder 300 for core encoding core encoder input data, a metadata compressor 400 for compressing the metadata related to the one or more of the plurality of audio objects.

Furthermore, the 3D audio encoder can comprise a mode controller 600 for controlling the mixer, the core encoder and/or an output interface 500 in one of several operation modes, wherein in the first mode, the core encoder is configured to encode the plurality of audio channels and the plurality of audio objects received by the input interface 1100 without any interaction by the mixer, i.e., without any mixing by the mixer 200. In a second mode, however, in which the mixer 200 was active, the core encoder encodes the plurality of mixed channels, i.e., the output generated by block 200. In this latter case, it is advantageous to not encode any object data anymore. Instead, the metadata indicating positions of the audio objects are already used by the mixer 200 to render the objects onto the channels as indicated by the metadata. In other words, the mixer 200 uses the metadata related to the plurality of audio objects to pre-render the audio objects and then the pre-rendered audio objects are mixed with the channels to obtain mixed channels at the output of the mixer. In this embodiment, any objects may not necessarily be transmitted and this also applies for compressed metadata as output by block 400. However, if not all objects input into the interface 1100 are mixed but only a certain amount of objects is mixed, then only the remaining non-mixed objects and the associated metadata nevertheless are transmitted to the core encoder 300 or the metadata compressor 400, respectively.

Figure 6:
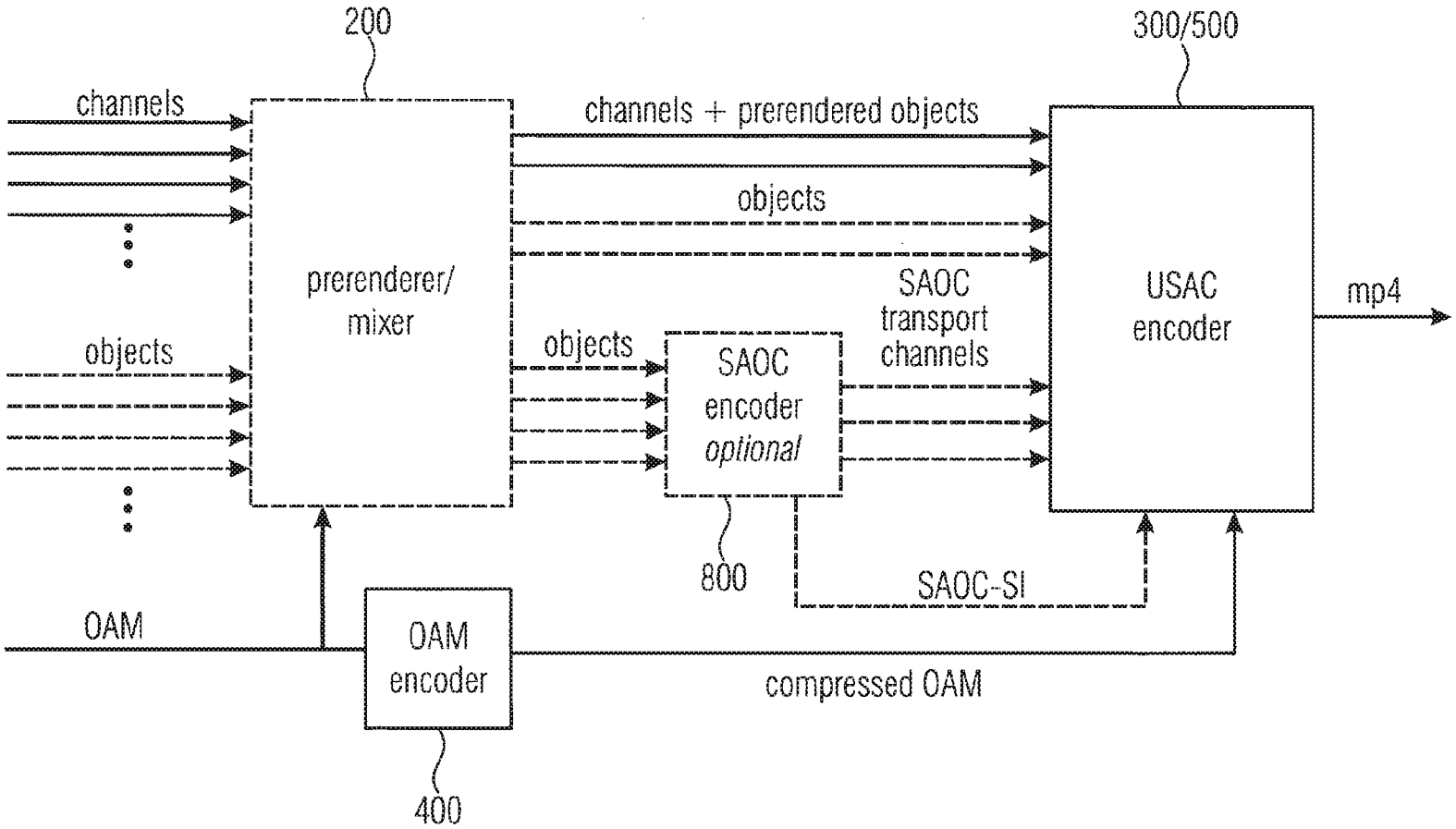
FIG. 6 illustrates a second embodiment of a 3D audio encoder.

FIG. 6 illustrates a further embodiment of an 3D audio encoder which, additionally, comprises an SAOC encoder 800. The SAOC encoder 800 is configured for generating one or more transport channels and parametric data from spatial audio object encoder input data. As illustrated in FIG. 6, the spatial audio object encoder input data are objects which have not been processed by the pre-renderer/mixer. Alternatively, provided that the pre-renderer/mixer has been bypassed as in the mode one where an individual channel/object coding is active, all objects input into the input interface 1100 are encoded by the SAOC encoder 800.

Furthermore, as illustrated in FIG. 6, the core encoder 300 is advantageously implemented as a USAC encoder, i.e., as an encoder as defined and standardized in the MPEG-USAC standard (USAC=Unified Speech and Audio Coding). The output of the whole 3D audio encoder illustrated in FIG. 6 is an MPEG 4 data stream, MPEG H data stream or 3D audio data stream having the container-like structures for individual data types. Furthermore, the metadata is indicated as "OAM" data and the metadata compressor 400 in FIG. 4 corresponds to the OAM encoder 400 to obtain compressed OAM data which are input into the USAC encoder 300 which, as can be seen in FIG. 6, additionally comprises the output interface to obtain the MP4 output data stream not only having the encoded channel/object data but also having the compressed OAM data.

Figure 8:
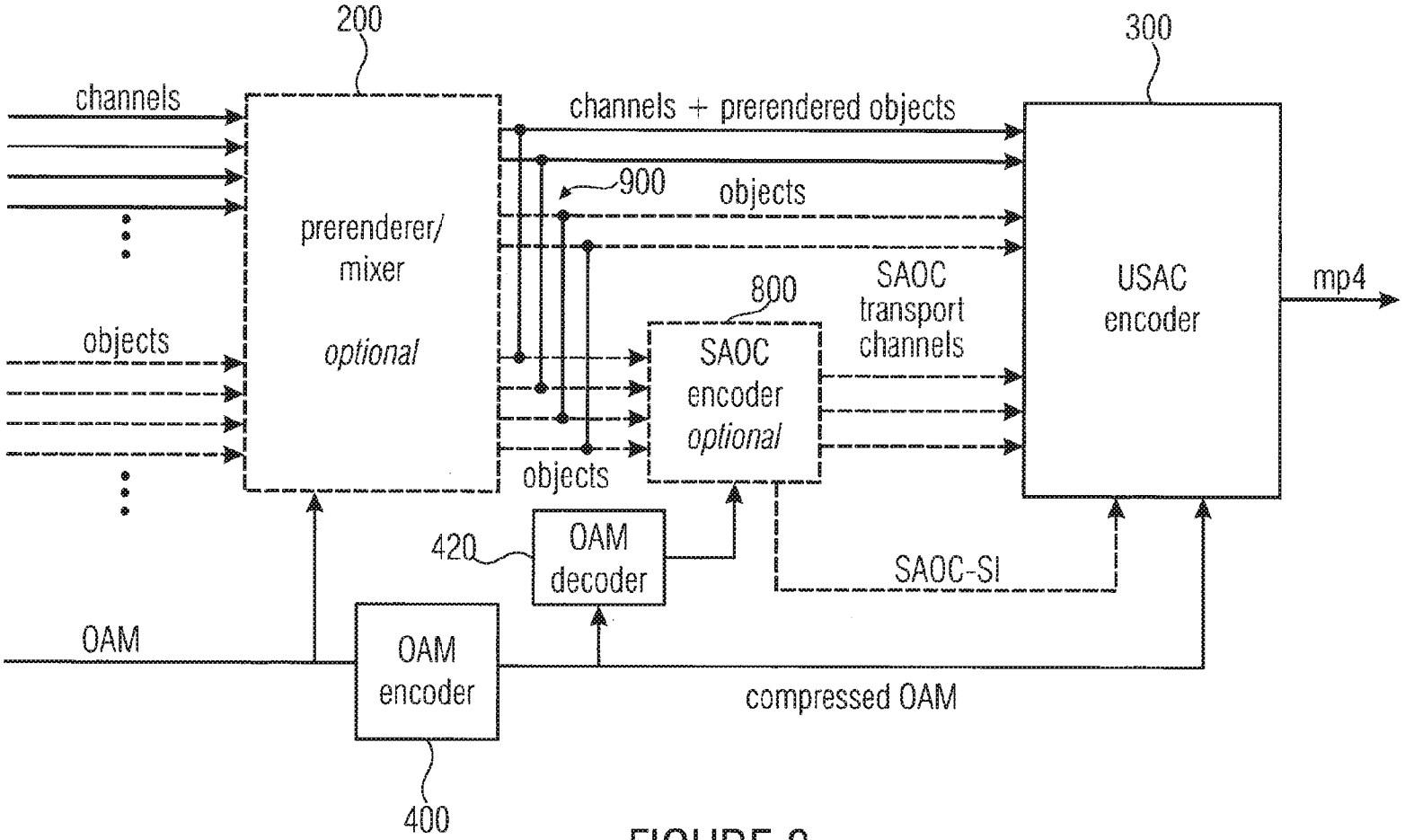
FIG. 8 illustrates a third embodiment of a 3D audio encoder.

FIG. 8 illustrates a further embodiment of the 3D audio encoder, where in contrast to FIG. 6, the SAOC encoder can be configured to either encode, with the SAOC encoding algorithm, the channels provided at the pre-renderer/mixer 200 not being active in this mode or, alternatively, to SAOC encode the pre-rendered channels plus objects. Thus, in FIG. 8, the SAOC encoder 800 can operate on three different kinds of input data, i.e., channels without any pre-rendered objects, channels and pre-rendered objects or objects alone. Furthermore, it is advantageous to provide an additional OAM decoder 420 in FIG. 8 so that the SAOC encoder 800 uses, for its processing, the same data as on the decoder side, i.e., data obtained by a lossy compression rather than the original OAM data.

The FIG. 8 3D audio encoder can operate in several individual modes.

In addition to the first and the second modes as discussed in the context of FIG. 4, the FIG. 8 3D audio encoder can additionally operate in a third mode in which the core encoder generates the one or more transport channels from the individual objects when the pre-renderer/mixer 200 was not active. Alternatively or additionally, in this third mode the SAOC encoder 800 can generate one or more alternative or additional transport channels from the original channels, i.e., again when the pre-renderer/mixer 200 corresponding to the mixer 200 of FIG. 4 was not active.

Figure 3:
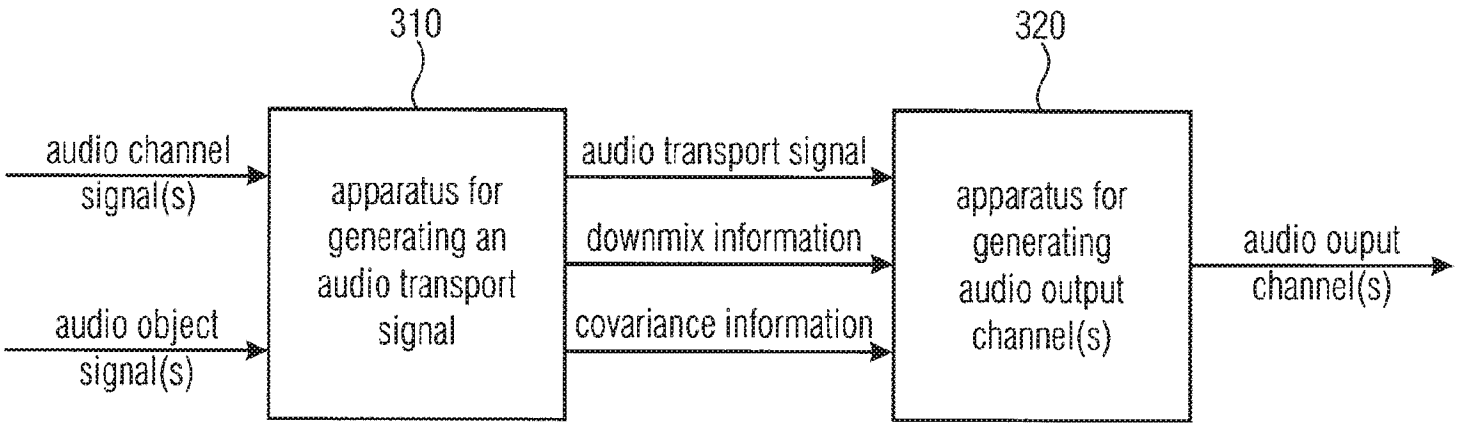
FIG. 3 illustrates a system according to an embodiment.

Finally, the SAOC encoder 800 can encode, when the 3D audio encoder is configured in the fourth mode, the channels plus pre-rendered objects as generated by the pre-renderer/mixer. Thus, in the fourth mode the lowest bit rate applications will provide good quality due to the fact that the channels and objects have completely been transformed into individual SAOC transport channels and associated side information as indicated in FIGS. 3 and 5 as "SAOC-SI" and, additionally, any compressed metadata do not have to be transmitted in this fourth mode.

Figure 5:
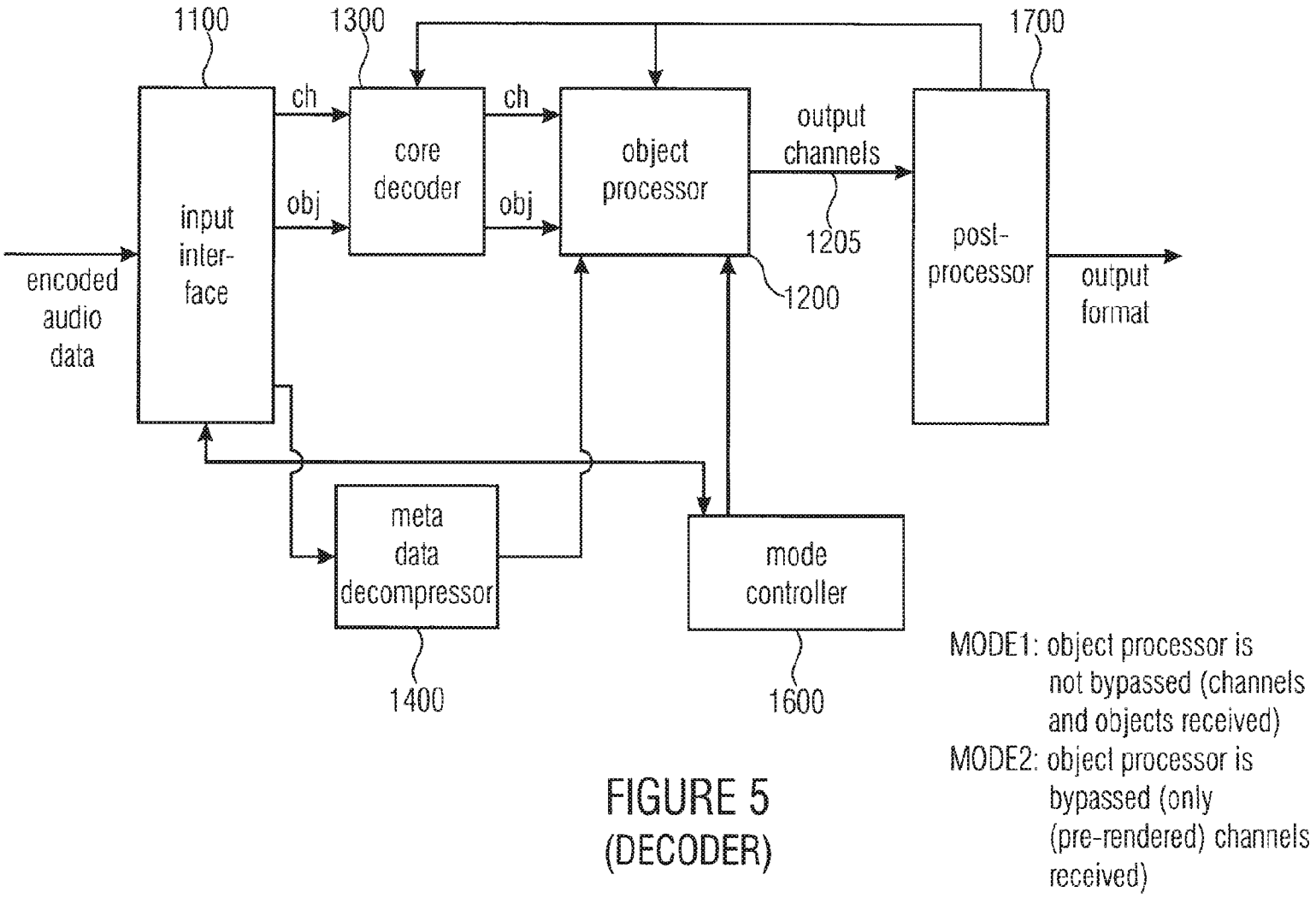
FIG. 5 illustrates a first embodiment of a 3D audio decoder.

FIG. 5 illustrates a 3D audio decoder in accordance with an embodiment of the present invention. The 3D audio decoder receives, as an input, the encoded audio data, i.e., the data 501 of FIG. 4.

The 3D audio decoder comprises a metadata decompressor 1400, a core decoder 1300, an object processor 1200, a mode controller 1600 and a postprocessor 1700.

Specifically, the 3D audio decoder is configured for decoding encoded audio data and the input interface is configured for receiving the encoded audio data, the encoded audio data comprising a plurality of encoded channels and the plurality of encoded objects and compressed metadata related to the plurality of objects in a certain mode.

Furthermore, the core decoder 1300 is configured for decoding the plurality of encoded channels and the plurality of encoded objects and, additionally, the metadata decompressor is configured for decompressing the compressed metadata.

Furthermore, the object processor 1200 is configured for processing the plurality of decoded objects as generated by the core decoder 1300 using the decompressed metadata to obtain a predetermined number of output channels comprising object data and the decoded channels. These output channels as indicated at 1205 are then input into a postprocessor 1700. The postprocessor 1700 is configured for converting the number of output channels 1205 into a certain output format which can be a binaural output format or a loudspeaker output format such as a 5.1, 7.1, etc., output format.

Advantageously, the 3D audio decoder comprises a mode controller 1600 which is configured for analyzing the encoded data to detect a mode indication. Therefore, the mode controller 1600 is connected to the input interface 1100 in FIG. 5. However, alternatively, the mode controller does not necessarily have to be there. Instead, the flexible audio decoder can be pre-set by any other kind of control data such as a user input or any other control. The 3D audio decoder in FIG. 5 and, advantageously controlled by the mode controller 1600, is configured to either bypass the object processor and to feed the plurality of decoded channels into the postprocessor 1700. This is the operation in mode 2, i.e., in which only pre-rendered channels are received, i.e., when mode 2 has been applied in the 3D audio encoder of FIG. 4. Alternatively, when mode 1 has been applied in the 3D audio encoder, i.e., when the 3D audio encoder has performed individual channel/object coding, then the object processor 1200 is not bypassed, but the plurality of decoded channels and the plurality of decoded objects are fed into the object processor 1200 together with decompressed metadata generated by the metadata decompressor 1400.

Advantageously, the indication whether mode 1 or mode 2 is to be applied is included in the encoded audio data and then the mode controller 1600 analyses the encoded data to detect a mode indication. Mode 1 is used when the mode indication indicates that the encoded audio data comprises encoded channels and encoded objects and mode 2 is applied when the mode indication indicates that the encoded audio data does not contain any audio objects, i.e., only contain pre-rendered channels obtained by mode 2 of the FIG. 4 3D audio encoder.

Figure 7:
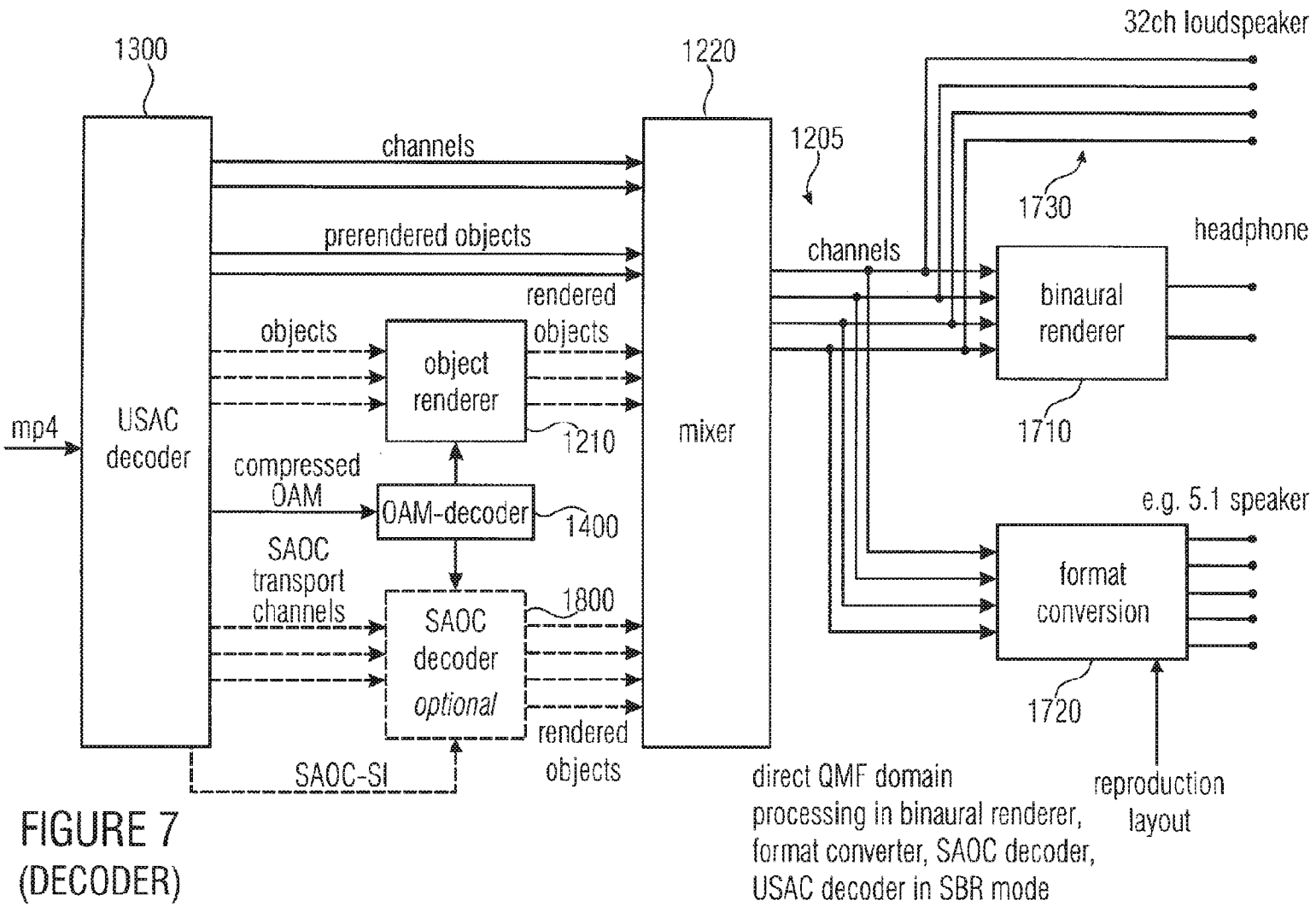
FIG. 7 illustrates a second embodiment of a 3D audio decoder.

FIG. 7 illustrates an advantageous embodiment compared to the FIG. 5 3D audio decoder and the embodiment of FIG. 7 corresponds to the 3D audio encoder of FIG. 6. In addition to the 3D audio decoder implementation of FIG. 5, the 3D audio decoder in FIG. 7 comprises an SAOC decoder 1800. Furthermore, the object processor 1200 of FIG. 5 is implemented as a separate object renderer 1210 and the mixer 1220 while, depending on the mode, the functionality of the object renderer 1210 can also be implemented by the SAOC decoder 1800.

Furthermore, the postprocessor 1700 can be implemented as a binaural renderer 1710 or a format converter 1720. Alternatively, a direct output of data 1205 of FIG. 5 can also be implemented as illustrated by 1730. Therefore, it is advantageous to perform the processing in the decoder on the highest number of channels such as 22.2 or 32 in order to have flexibility and to then post-process if a smaller format is useful. However, when it becomes clear from the very beginning that only small format such as a 5.1 format is useful, then it is advantageous, as indicated by FIG. 5 or 6 by the shortcut 1727, that a certain control over the SAOC decoder and/or the USAC decoder can be applied in order to avoid unnecessary upmixing operations and subsequent downmixing operations.

In an advantageous embodiment of the present invention, the object processor 1200 comprises the SAOC decoder 1800 and the SAOC decoder is configured for decoding one or more transport channels output by the core decoder and associated parametric data and using decompressed metadata to obtain the plurality of rendered audio objects. To this end, the OAM output is connected to box 1800.

Furthermore, the object processor 1200 is configured to render decoded objects output by the core decoder which are not encoded in SAOC transport channels but which are individually encoded in typically single channeled elements as indicated by the object renderer 1210. Furthermore, the decoder comprises an output interface corresponding to the output 1730 for outputting an output of the mixer to the loudspeakers.

In a further embodiment, the object processor 1200 comprises a spatial audio object coding decoder 1800 for decoding one or more transport channels and associated parametric side information representing encoded audio signals or encoded audio channels, wherein the spatial audio object coding decoder is configured to transcode the associated parametric information and the decompressed metadata into transcoded parametric side information usable for directly rendering the output format, as for example defined in an earlier version of SAOC. The postprocessor 1700 is configured for calculating audio channels of the output format using the decoded transport channels and the transcoded parametric side information. The processing performed by the post processor can be similar to the MPEG Surround processing or can be any other processing such as BCC processing or so.

In a further embodiment, the object processor 1200 comprises a spatial audio object coding decoder 1800 configured to directly upmix and render channel signals for the output format using the decoded (by the core decoder) transport channels and the parametric side information Furthermore, and importantly, the object processor 1200 of FIG. 5 additionally comprises the mixer 1220 which receives, as an input, data output by the USAC decoder 1300 directly when pre-rendered objects mixed with channels exist, i.e., when the mixer 200 of FIG. 4 was active. Additionally, the mixer 1220 receives data from the object renderer performing object rendering without SAOC decoding. Furthermore, the mixer receives SAOC decoder output data, i.e., SAOC rendered objects.

The mixer 1220 is connected to the output interface 1730, the binaural renderer 1710 and the format converter 1720. The binaural renderer 1710 is configured for rendering the output channels into two binaural channels using head related transfer functions or binaural room impulse responses (BRIR). The format converter 1720 is configured for converting the output channels into an output format having a lower number of channels than the output channels 1205 of the mixer and the format converter 1720 may use information on the reproduction layout such as 5.1 speakers or so.

Figure 9:
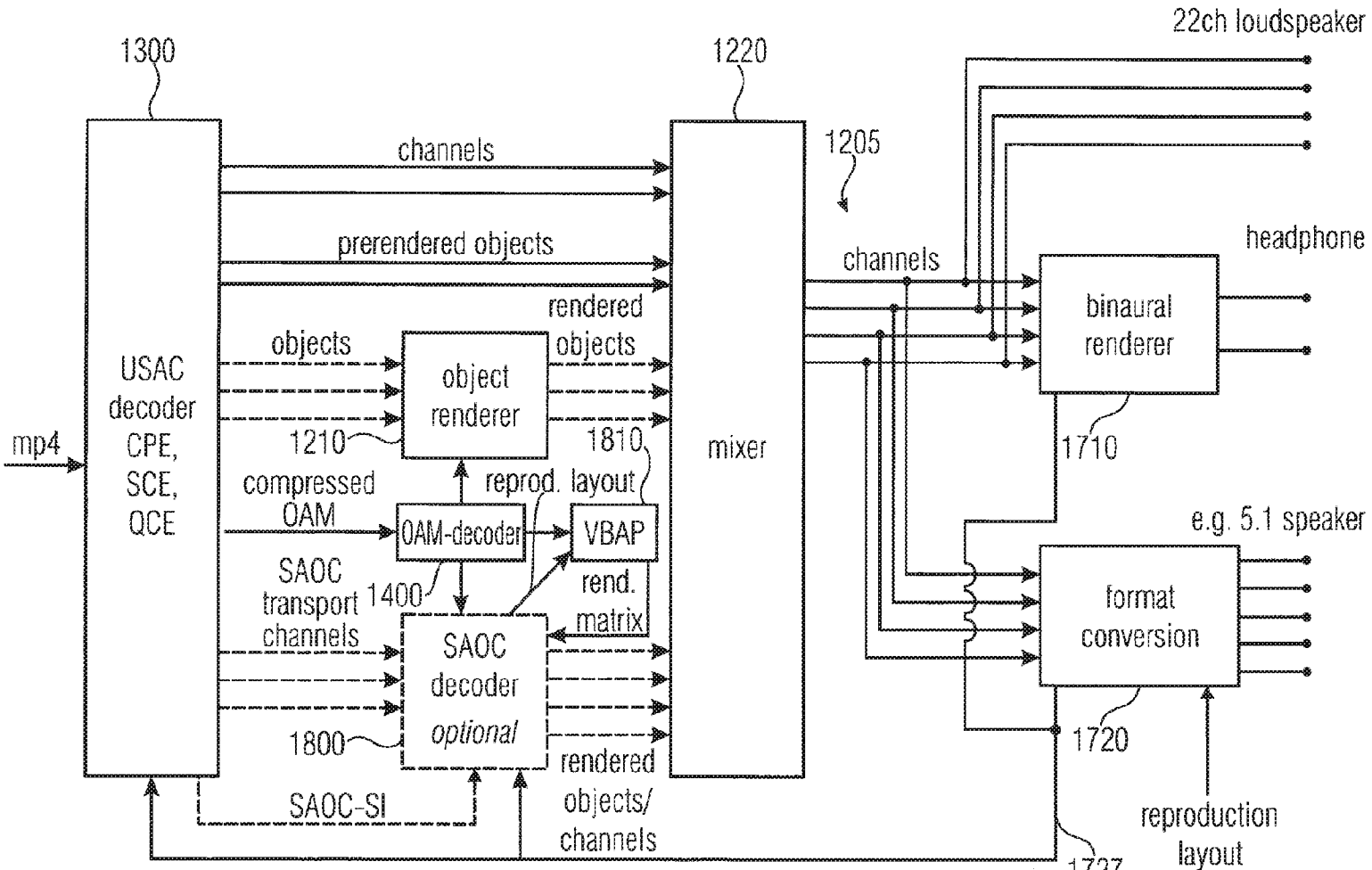
FIG. 9 illustrates a third embodiment of a 3D audio decoder.
Figure 10:
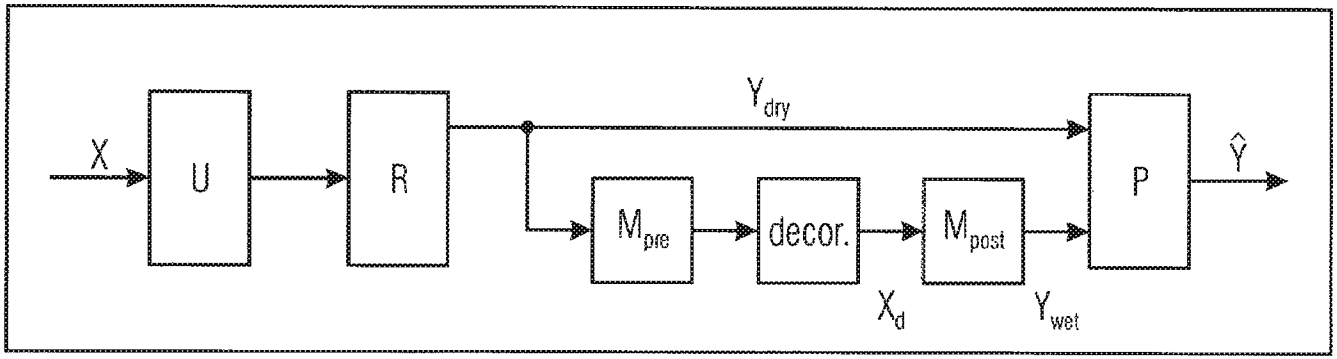
FIG. 10 illustrates a joint processing unit according to an embodiment.

The FIG. 9 3D audio decoder is different from the FIG. 7 3D audio decoder in that the SAOC decoder cannot only generate rendered objects but also rendered channels and this is the case when the FIG. 8 3D audio encoder has been used and the connection 900 between the channels/pre-rendered objects and the SAOC encoder 800 input interface is active.

Furthermore, a vector base amplitude panning (VBAP) stage 1810 is configured which receives, from the SAOC decoder, information on the reproduction layout and which outputs a rendering matrix to the SAOC decoder so that the SAOC decoder can, in the end, provide rendered channels without any further operation of the mixer in the high channel format of 1205, i.e., 32 loudspeakers.

the VBAP block advantageously receives the decoded OAM data to derive the rendering matrices. More general, it advantageously may use geometric information not only of the reproduction layout but also of the positions where the input signals should be rendered to on the reproduction layout. This geometric input data can be OAM data for objects or channel position information for channels that have been transmitted using SAOC.

However, if only a specific output interface may be used then the VBAP state 1810 can already provide the rendering matrix that may be used for the e.g., 5.1 output. The SAOC decoder 1800 then performs a direct rendering from the SAOC transport channels, the associated parametric data and decompressed metadata, a direct rendering into the output format that may be used without any interaction of the mixer 1220. However, when a certain mix between modes is applied, i.e., where several channels are SAOC encoded but not all channels are SAOC encoded or where several objects are SAOC encoded but not all objects are SAOC encoded or when only a certain amount of pre-rendered objects with channels are SAOC decoded and remaining channels are not SAOC processed then the mixer will put together the data from the individual input portions, i.e., directly from the core decoder 1300, from the object renderer 1210 and from the SAOC decoder 1800.

The following mathematical notation is employed:

$N_{Objects}$ number of input audio object signals $N_{Channels}$ number of input channels N number of input signals;

N can be equal with $N_{Objects}$, $N_{Channels}$ or $N_{Objects}+N_{Channels}$ $N_{DmxCh}$ number of downmix (processed) channels $N_{Samples}$ number of processed data samples $N_{OutputChannels}$ number of output channels at the decoder side D downmix matrix, size $N_{DmxCh} \times N$ X input audio signal, size $N \times N_{Samples}$ $E_X$ input signal covariance matrix, size N×N defined as $E_X=XX^H$ Y downmix audio signal, size $N_{DmxCh}\times N_{Samples}$ defined as Y=DX $E_Y$ covariance matrix of the downmix signals, size $N_{DmxCh}\times N_{DmxCh}$ defined as $E_Y=YY^H$ G parametric source estimation matrix, size $N\times N_{DmxCh}$ which approximates $E_X D^H (D E_X D^H)^{-1}$ $\hat{X}$ parametrically reconstructed input signals, size $N_{Objects}\times N_{Samples}$ which approximates X and defined as $\hat{X}=GY$ $(\bullet)^H$ self-adjoint (Hermitian) operator which represents the conjugate transpose of (•)

R rendering matrix of size $N_{OutputChannels}\times N$

S output channel generation matrix of size $N_{OutputChannels}\times N_{DmxCh}$ defined as S=RG Z output channels, size $N_{OutputChannels}\times N_{Samples}$, generated on the decoder side from the downmix signals, Z=SY $\hat{Z}$ desired output channels, size $N_{OutputChannels}\times N_{Samples}$, $\hat{Z}=RX$ Without loss of generality, in order to improve readability of equations, for all introduced variables the indices denoting time and frequency dependency are omitted in this document.

In the 3D Audio context, loudspeaker channels are distributed in several height layers, resulting in horizontal and vertical channel pairs. Joint coding of only two channels as defined in USAC is not sufficient to consider the spatial and perceptual relations between channels.

In order to consider the spatial and perceptual relations between channels, in the 3D Audio context, one could use SAOC-like parametric technique to reconstruct the input channels (audio channel signals and audio object signals that are encoded by the SAOC encoder) to obtain reconstructed input channels $\hat{X}$ at the decoder side. SAOC decoding is based on a Minimum Mean Squared Error (MMSE) Algorithm:

$$\hat{X}=GY \text{ with } G\approx E_X D^H (D E_X D^H)^{-1}$$

Instead of reconstructing input channels to obtain reconstructed input channels $\hat{X}$, the output channels Z can be directly generated at the decoder side by taking the rendering matrix R into account.

$$Z=R\hat{X}$$

$$Z=RGY$$

$$Z=SY; \text{ with } S=RG$$

As can be seen, instead of explicitly reconstructing the input audio objects and the input audio channels, the output channels Z may be directly generated by applying the output channel generation matrix S on the downmix audio signal Y.

To obtain the output channel generation matrix S, rendering matrix R may, e.g., be determined or may, e.g, be already available. Furthermore, the parametric source estimation matrix G may, e.g, be computed as described above. The output channel generation matrix S may then be obtained as the matrix product S=RG from the rendering matrix R and the parametric source estimation matrix G.

A 3D audio system may use a combined mode in order to encode channels and objects.

In general, for such a combined mode, SAOC encoding/decoding may be applied in two different ways:

One approach could be to employ one instance of a SAOC-like parametric system, wherein such an instance is capable to process channels and objects. This solution has the drawback that it is computational complex, because of the high number of input signals the number of transport channels will increase in order to maintain a similar reconstruction quality. As a consequence the size of the matrix D $E_X$ $D^H$ will increase and the inversion complexity will increase. Moreover, such a solution may introduce more numerical instabilities as the size of the matrix D $E_X$ $D^H$ increases. Furthermore, as another disadvantage, the inversion of the matrix D $E_X D^H$ may lead to additional cross-talk between reconstructed channels and reconstructed objects. This is caused because some coefficients in the reconstruction matrix G which are supposed to be equal to zero are set to non-zero values due to numerical inaccuracies.

Another approach could be to employ two instances of SAOC-like parametric systems, one instance for the channel based processing and another instance for the object based processing. Such an approach would have the drawback that the same information is transmitted twice for the initialization of the filterbanks and decoder configuration. Moreover, it is not possible to mix the channels and objects together if this is a requirement, and consequently not possible to use correlation properties between channels and objects.

To avoid the disadvantages of the approach which employs different instances for audio objects and audio channels, embodiments employ the first approach and provide an Enhanced SAOC System capable of processing channels, objects or channels and objects using only one system instance, in an efficient way. Although audio channels and audio objects are processed by the same encoder and decoder instance, respectively, efficient concepts are provided, so that the disadvantages of the first approach can be avoided.

Figure 2:
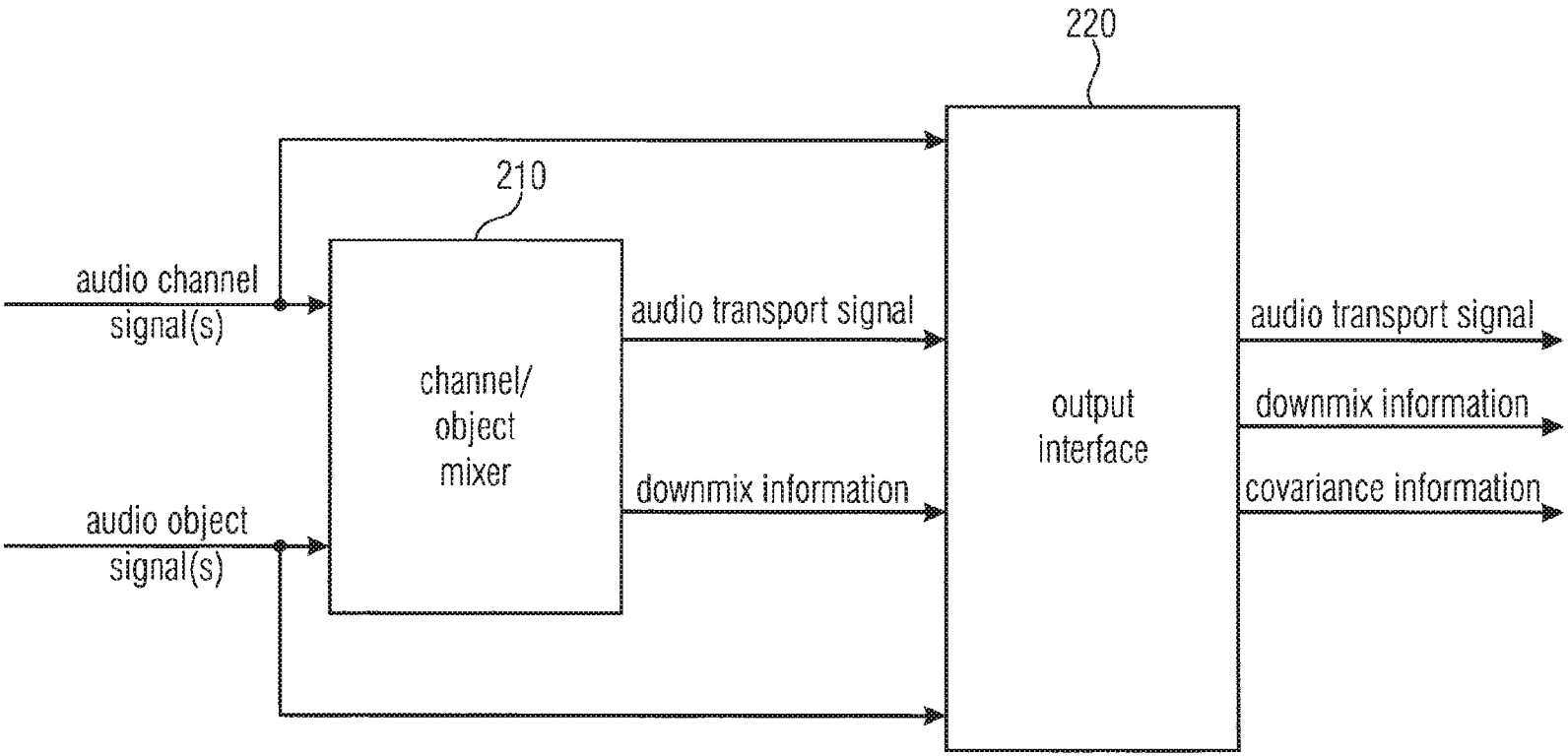
FIG. 2 illustrates an apparatus for generating an audio transport signal comprising one or more audio transport channels according to an embodiment.

FIG. 2 illustrates an apparatus for generating an audio transport signal comprising one or more audio transport channels according to an embodiment.

The apparatus comprises a channel/object mixer 210 for generating the one or more audio transport channels of the audio transport signal, and an output interface 220.

The channel/object mixer 210 is configured to generate the audio transport signal comprising the one or more audio transport channels by mixing one or more audio channel signals and one or more audio object signals within the audio transport signal depending on downmix information indicating information on how the one or more audio channel signals and the one or more audio object signals have to be mixed within the one or more audio transport channels.

The number of the one or more audio transport channels is smaller than the number of the one or more audio channel signals plus the number of the one or more audio object signals. Thus, the channel/object mixer 210 is capable of downmixing the one or more audio channel signals plus and the one or more audio object signals, as the channel/object mixer 210 is adapted to generate an audio transport signal that has fewer channels than the number of the one or more audio channel signals plus the number of the one or more audio object signals.

The output interface 220 is configured to output the audio transport signal, the downmix information and covariance information.

For example, the channel/object mixer 210 may be configured to feed the downmix information, that is used for downmixing the one or more audio channel signals and the one or more audio object signals, into the output interface 220. Moreover, for example, the output interface 220, may, for example, be configured to receive the one or more audio channel signals and the one or more audio object signals and may moreover be configured to determine the covariance information based on the one or more audio channel signals and the one or more audio object signals. Or, the output interface 220 may, for example, be configured to receive the already determined covariance information.

The covariance information indicates a level difference information for at least one of the one or more audio channel signals and further indicates a level difference information for at least one of the one or more audio object signals. However, the covariance information does not indicate correlation information for any pair of one of the one or more audio channel signals and one of the one or more audio object signals.

Figure 1:
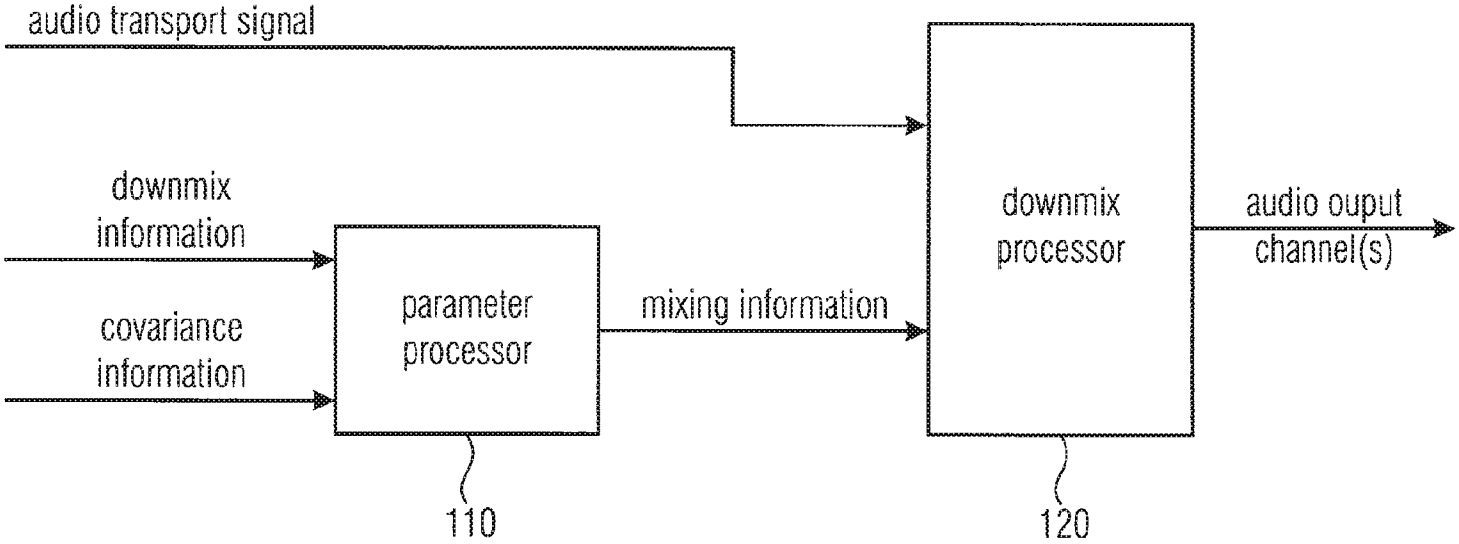
FIG. 1 illustrates an apparatus for generating one or more audio output channels according to an embodiment.

FIG. 1 illustrates an apparatus for generating one or more audio output channels according to an embodiment.

The apparatus comprises a parameter processor 110 for calculating mixing information and a downmix processor 120 for generating the one or more audio output channels.

The downmix processor 120 is configured to receive an audio transport signal comprising one or more audio transport channels. One or more audio channel signals are mixed within the audio transport signal. Moreover, one or more audio object signals are mixed within the audio transport signal. The number of the one or more audio transport channels is smaller than the number of the one or more audio channel signals plus the number of the one or more audio object signals.

The parameter processor 110 is configured to receive downmix information indicating information on how the one or more audio channel signals and the one or more audio object signals are mixed within the one or more audio transport channels. Moreover, the parameter processor 110 is configured to receive covariance information. The parameter processor 110 is configured to calculate the mixing information depending on the downmix information and depending on the covariance information.

The downmix processor 120 is configured to generate the one or more audio output channels from the audio transport signal depending on the mixing information.

The covariance information indicates a level difference information for at least one of the one or more audio channel signals and further indicates a level difference information for at least one of the one or more audio object signals. However, the covariance information does not indicate correlation information for any pair of one of the one or more audio channel signals and one of the one or more audio object signals.

In an embodiment, the covariance information may, e.g., indicate a level difference information for each of the one or more audio channel signals and, may further, e.g., indicate a level difference information for each of the one or more audio object signals.

According to an embodiment, two or more audio object signals may, e.g., be mixed within the audio transport signal and two or more audio channel signals may, e.g., be mixed within the audio transport signal. The covariance information may, e.g., indicate correlation information for one or more pairs of a first one of the two or more audio channel signals and a second one of the two or more audio channel signals. Or, the covariance information may, e.g., indicate correlation information for one or more pairs of a first one of the two or more audio object signals and a second one of the two or more audio object signals. Or, the covariance information may, e.g., indicate correlation information for one or more pairs of a first one of the two or more audio channel signals and a second one of the two or more audio channel signals and indicates correlation information for one or more pairs of a first one of the two or more audio object signals and a second one of the two or more audio object signals.

A level difference information for an audio object signal may, for example, be an object level difference (OLD). "Level" may, e.g., relate to an energy level. "Difference" may, e.g., relate to a difference with respect to a maximum level among the audio object signals.

A correlation information for a pair of a first one of the audio object signals and a second one of the audio object signals may, for example, be an inter-object correlation (IOC).

For example, according to an embodiment, in order to guarantee optimum performance of SAOC 3D it is recommended to use the input audio object signals with compatible power. The product of two input audio signals (normalized according the corresponding time/frequency tiles) is determined as:

$$nrg_{i,j}^{l,m} = \frac{\sum_{n\in l}\sum_{k\in m} x_i^{n,k}\left(x_j^{n,k}\right)^H}{\sum_{n\in l}\sum_{k\in m} 1} + \varepsilon.$$

Here, i and j are indices for the audio object signals $x_i$ and $x_j$, respectively, n indicates time, k indicates frequency, l indicates a set of time indices and m indicates a set of frequency indices. $\epsilon$ is an additive constant to avoid division by zero, e.g., $\epsilon=10^{-9}$.

The absolute object energy (NRG) of the object with the highest energy may, e.g., be calculated as:

$$NRG^{l,m} = \max_i(nrg_{i,i}^{l,m}).$$

The ratio of the powers of corresponding input object signal (OLD) may, e.g., be given by $$OLD_i^{l,m} = \frac{nrg_{i,i}^{l,m}}{NRG^{l,m}}.$$

A similarity measure of the input objects (IOC), may, e.g., be given by the cross correlation:

$$IOC_{i,j}^{l,m} = \mathrm{Re}\left\{\frac{nrg_{i,j}^{l,m}}{\sqrt{nrg_{i,i}^{l,m}\,nrg_{j,j}^{l,m}}}\right\}.$$

For example, in an embodiment, the IOCs may be transmitted for all pairs of audio signals i and j, for which a bitstream variable bsRelatedTo[i][j] is set to one.

A level difference information for an audio channel signal may, for example, be a channel level difference (CLD). "Level" may, e.g., relate to an energy level. "Difference" may, e.g., relate to a difference with respect to a maximum level among the audio channel signals.

A correlation information for a pair of a first one of the audio channel signals and a second one of the audio channel signals may, for example, be an inter-channel correlation (ICC).

In an embodiment, the channel level difference (CLD) may be defined in the same way as the object level difference (OLD) above, when the audio object signals in the above formulae are replaced by audio channel signals. Moreover, the inter-channel correlation (ICC) may be defined in the same way as the inter-object correlation (IOC) above, when the audio object signals in the above formulae are replaced by audio channel signals.

In SAOC, an SAOC encoder downmixes (according to downmix information, e.g., according to a downmix matrix D) a plurality of audio object signals to obtain (e.g., a fewer number of) one or more audio transport channels. On the decoder side, a SAOC decoder decodes the one or more audio transport channels using the downmix information received from the encoder and using covariance information received from the encoder. The covariance information may, for example, be the coefficients of a covariance matrix E, which indicates the object level differences of the audio object signals and the inter object correlations between two audio object signals. In SAOC, a determined downmix matrix D and a determined covariance matrix E is used to decode a plurality of samples of the one or more audio transport channels (e.g., 2048 samples of the one or more audio transport channels). By employing this concept, bitrate is saved compared to transmitting the one or more audio object signals without encoding.

Embodiments are based on the finding, that although audio object signals and audio channel signals exhibit significant differences, an audio transport signal may be generated by an enhanced SAOC encoder, so that in such an audio transport signal, not only audio object signals, but also audio channel signals are mixed.

Audio object signals and audio channel signals significantly differ. For example, each of a plurality of audio object signals may represent an audio source of a sound scene. Therefore, in general, two audio objects may be highly uncorrelated. In contrast, audio channel signals represent different channels of a sound scene, as if being recorded by different microphones. In general, two of such audio channel signals are highly correlated, in particular, compared to the correlation of two audio object signals, which are, in general, highly uncorrelated. Thus, embodiments are based on the finding that audio channel signals particularly benefit from transmitting the correlation between a pair of two audio channel signals and by using this transmitted correlation value for decoding.

Moreover, audio object signals and audio channel signals differ in that, position information is assigned to audio object signals, for example, indicating an (assumed) position of a sound source (e.g., an audio object) from which an audio object signal originates. Such position information (e.g., comprised in metadata information) can be used when generating audio output channels from the audio transport signal on the decoder side. However, in contrast, audio channel signals do not exhibit a position, and no position information is assigned to audio channel signals. However, embodiments are based on the finding that it is nevertheless efficient to SAOC encode audio channel signals together with audio object signals, e.g, as generating the audio channel signals can be divided into two subproblems, namely, determining decoding information (for example, determining matrix G for unmixing, see below), for which no position information is needed, and determining rendering information (for example, by determining a rendering matrix R, see below), for which position information on the audio object signals may be employed to render the audio objects in the audio output channels that are generated.

Moreover, the present invention is based on the finding that no correlation (or at least no significant) exists between any pair of one of the audio object signals and one of the audio channel signals. Therefore, when the encoder does not transmit correlation information for any pair of one of the one or more audio channel signals and one of the one or more audio object signals. By this, significant transmission bandwidth is saved and a significant amount of computation time is saved for both encoding and decoding. A decoder that is configured to not process such insignificant correlation information saves a significant amount of computation time when determining the mixing information (which is employed for generating the audio output channels from the audio transport signal on the decoder side).

According to an embodiment, the parameter processor 110 may, e.g., be configured to receive rendering information indicating information on how the one or more audio channel signals and the one or more audio object signals are mixed within the one or more audio output channels. The parameter processor 110 may, e.g., be configured to calculate the mixing information depending on the downmix information, depending on the covariance information and depending on rendering information.

For example, the parameter processor 110 may, for example, be configured to receive a plurality of coefficients of a rendering matrix R as the rendering information, and may be configured to calculate the mixing information depending on the downmix information, depending on the covariance information and depending on the rendering matrix R. E.g., the parameter processor may receive the coefficients of the rendering matrix R from an encoder side, or from a user. In another embodiment, the parameter processor 110 may, for example, be configured to receive metadata information, e.g., position information or gain information, and may, e.g., be configured to calculate the coefficients of the rendering matrix R depending on the received metadata information. In a further embodiment, the parameter processor may be configured to receive both (rendering information from encoder and from the user) and to create the rendering matrix based on both (which basically means that interactivity is realized).

Or, the parameter processor may, e.g., receive two rendering submatrices $R_{ch}$, $R_{obj}$, as rendering information, wherein $R=(R_{ch}, R_{obj})$, wherein $R_{ch}$ e.g., indicates how to mix the audio channel signals to the audio output channels and wherein $R_{obj}$ may be a rendering matrix obtained from the OAM information, wherein $R_{obj}$ may, e.g., be provided by the VBAP block 1810 of FIG. 9.

In a particular embodiment, two or more audio object signals may, e.g., be mixed within the audio transport signal, two or more audio channel signals are mixed within the audio transport signal. In such an embodiment, the covariance information may, e.g., indicate correlation information for one or more pairs of a first one of the two or more audio channel signals and a second one of the two or more audio channel signals. Moreover, in such an embodiment, the covariance information (that is e.g., transmitted from an encoder side to a decoder side) does not indicate correlation information for any pair of a first one of the one or more audio object signals and a second one of the one or more audio object signals, because the correlation between the audio object signals may be so small, that it can be neglected, and is thus, for example, not transmitted to save bitrate and processing time. In such an embodiment, the parameter processor 110 is configured to calculate the mixing information depending on the downmix information, depending on a the level difference information of each of the one or more audio channel signals, depending on the second level difference information of each of the one or more audio object signals, and depending on the correlation information of the one or more pairs of a first one of the two or more audio channel signals and a second one of the two or more audio channel signals. Such an embodiment employs the above described finding that a correlation between audio object signals is in general relatively low and should be neglected, while a correlation between two audio channel signals is in general, relatively high and should be considered. By not processing irrelevant correlation information between audio object signals, processing time can be saved. By processing relevant correlation between audio channel signals, coding efficiency can be enhanced.

In particular embodiments, the one or more audio channel signals are mixed within a first group of one or more of the audio transport channels, wherein the one or more audio object signals are mixed within a second group of one or more of the audio transport channels, wherein each audio transport channel of the first group is not comprised by the second group, and wherein each audio transport channel of the second group is not comprised by the first group. In such embodiments, he downmix information comprises first downmix subinformation indicating information on how the one or more audio channel signals are mixed within the first group of the one or more audio transport channels, and the downmix information comprises second downmix subinformation indicating information on how the one or more audio object signals are mixed within the second group of the one or more audio transport channels. In such embodiments, the parameter processor 110 is configured to calculate the mixing information depending on the first downmix subinformation, depending on the second downmix subinformation and depending on the covariance information, and the downmix processor 120 is configured to generate the one or more audio output signals from the first group of one or more audio transport channels and from the second group of audio transport channels depending on the mixing information. By such an approach coding efficiency is increased, as between audio channel signals of a sound scene, a high correlation exists. Moreover, coefficients of the downmix matrix indicating an influence of audio channel signals on the audio transport channels, which encode audio object signals, and vice versa, do not have to be calculated by the encoder, do not have to be transmitted, and can be set to zero by the decoder without the need of processing them. This saves transmission bandwidth and computation time for encoder and decoder.

In an embodiment, the downmix processor 120 is configured to receive the audio transport signal in a bitstream, the downmix processor 120 is configured to receive a first channel count number indicating the number of the audio transport channels encoding only audio channel signals, and the downmix processor 120 is configured to receive a second channel count number indicating the number of the audio transport channels encoding only audio object signals. In such an embodiment, the downmix processor 120 is configured to identify whether an audio transport channel of the audio transport signal encodes audio channel signals or whether an audio transport channel of the audio transport signal encodes audio object signals depending on the first channel count number or depending on the second channel count number, or depending on the first channel count number and the second channel count number. For example, in the bitstream, the audio transport channels which encode audio channel signals appear first and the audio transport channels which encode audio object signals appear afterwards. Then, if the first channel count number is, e.g., 3 and the second channel count number is, e.g., 2, the downmix processor can conclude that the first three audio transport channels comprise encoded audio channel signals and the subsequent two audio transport channels comprise encoded audio object signals.

In an embodiment, the parameter processor 110 is configured to receive metadata information comprising position information, wherein the position information indicates a position for each of the one or more audio object signals, and wherein the position information does not indicate a position for any of the one or more audio channel signals. In such an embodiment the parameter processor 110 is configured to calculate the mixing information depending on the downmix information, depending on the covariance information, and depending on the position information. Additionally or alternatively, the metadata information further comprises gain information, wherein the gain information indicates a gain value for each of the one or more audio object signals, and wherein the gain information does not indicate a gain value for any of the one or more audio channel signals. In such an embodiment, the parameter processor 110 may be configured to calculate the mixing information depending on the downmix information, depending on the covariance information, depending on the position information, and depending on the gain information. For example, the parameter processor 110 may be configured to calculate the mixing information furthermore depending on the submatrix $R_{ch}$ described above.

According to an embodiment, the parameter processor 110 is configured to calculate a mixing matrix S as the mixing information, wherein the mixing matrix S is defined according to the formula S=RG, wherein G is a decoding matrix depending on the downmix information and depending on the covariance information, wherein R is a rendering matrix depending on the metadata information. In such an embodiment, the downmix processor (120) may be configured to generate the one or more audio output channels of the audio output signal by applying the formula Z=SY, wherein Z is the audio output signal, and wherein Y is the audio transport signal. E.g., R may depend on the submatrices $R_{ch}$ and/or $R_{obj}$ (e.g., $R=(R_{ch}, R_{obj})$) described above.

FIG. 3 illustrates a system according to an embodiment. The system comprises an apparatus 310 for generating an audio transport signal as described above and an apparatus 320 for generating one or more audio output channels as described above.

The apparatus 320 for generating the one or more audio output channels is configured to receive the audio transport signal, downmix information and covariance information from the apparatus 310 for generating the audio transport signal. Moreover, the apparatus 320 for generating the audio output channels is configured to generate the one or more audio output channels depending from the audio transport signal depending on the downmix information and depending on the covariance information.

According to embodiments, the functionality of the SAOC system, which is an object oriented system that realizes object coding, is extended so that audio objects (object coding) or audio channels (channel coding) or both audio channels and audio objects (mixed coding) can be encoded.

The SAOC encoder 800 of FIGS. 6 and 8 described above is enhanced, so that not only it can receive audio objects as input, but it can also receive audio channels as input, and so that the SAOC encoder can generate downmix channels (e.g., SAOC transport channels) in which the received audio objects and the received audio channels are encoded. In the above-described embodiments, e.g., of FIGS. 6 and 8, such a SAOC encoder 800 receives not only audio objects but also audio channels as input and generates downmix channels (e.g., SAOC transport channels) in which the received audio objects and the received audio channels are encoded. For example, the SAOC encoder of FIGS. 6 and 8 is implemented as an apparatus for generating an audio transport signal (comprising one or more audio transport channels, e.g., one or more SAOC transport channels) as described with reference to FIG. 2, and the embodiments of FIGS. 6 and 8 are modified such that not only objects but also one, some or all of the channels are fed into the SAOC encoder 800.

The SAOC decoder 1800 of FIGS. 7 and 9 described above is enhanced, so that it can receive downmix channels (e.g., SAOC transport channels) in which the audio objects and the audio channels are encoded, and so that it can generate the output channels (rendered channel signals and rendered object signals) from the received downmix channels (e.g., SAOC transport channels) in which the audio objects and the audio channels are encoded. In the above-described embodiments, e.g., of FIGS. 7 and 9, such a SAOC decoder 1800 receives downmix channels (e.g., SAOC transport channels) in which not only audio objects but also audio channels are encoded and generates the output channels (rendered channel signals and rendered object signals) from the received downmix channels (e.g., SAOC transport channels) in which the audio objects and the audio channels are encoded. For example, the SAOC decoder of FIGS. 7 and 9 is implemented as an apparatus for generating one or more audio output channels as described with reference to FIG. 1, and the embodiments of FIGS. 7 and 9 are modified such that one, some or all of the channels illustrated between the USAC decoder 1300 and the mixer 1220 are not generated (reconstructed) by the USAC decoder 1300, but are instead reconstructed by the SAOC decoder 1800 from the SAOC transport channels (audio transport channels).

Depending on the application, different advantages of a SAOC system can be exploited by using such an enhanced SAOC system.

According to some embodiments, such an enhanced SAOC system supports an arbitrary number of downmix channels and rendering to arbitrary number of output channels. In some embodiments, for example, the number of downmix channels (SAOC Transport Channels) can be reduced (e.g., at runtime), e.g., to scale down the overall bitrate significantly. This will lead to low bitrates.

Moreover, according to some embodiments, the SAOC decoder of such an enhanced SAOC system may, for example, have an integrated flexible renderer which may, e.g., allow user interaction. By this, the user can change the position of the objects in the audio scene, attenuate or increase the level of individual objects, completely suppress objects, etc. For example, considering the channel signals as background objects (BGOs) and the object signals as foreground objects (FGOs), the interactivity feature of SAOC may be used for applications like dialogue enhancement. By such an interactivity feature, the user may have the freedom to manipulate, in a limited range, the BGOs and FGOs, in order to increase the dialogue intelligibility (e.g., the dialogue may be represented by foreground objects) or to obtain a balance between dialogue (e.g., represented by FGOs) and the ambient background (e.g., represented by BGOs).

Furthermore, according to embodiments, depending on the available computation complexity at the decoder side, the SAOC decoder can scale down automatically the computational complexity by operating in a "low-computation-complexity" mode, for example, by reducing the number of decorrelators, and/or, for example, by rendering directly to the reproduction layout and deactivate the subsequent format converter 1720 that has been described above. For example, rendering information may steer how to downmix the channels of a 22.2 system to the channels of a 5.1 system.

According to embodiments, the Enhanced SAOC encoder may process a variable number of input channels ($N_{Channels}$) and input objects ($N_{Objects}$). The number of channels and objects are transmitted into the bitstream in order to signal to the decoder side the presence of the channel path. The input signals to the SAOC encoder are ordered such that the channel signals are the first ones and the object signals are the last ones.

According to another embodiment, channel/object mixer 210 is configured to generate the audio transport signal so that the number of the one or more audio transport channels of the audio transport signal depends on how much bitrate is available for transmitting the audio transport signal.

For example, the number of downmix (transport) channels may, e.g, be computed as a function of the available bitrate and total number of input signals:

$$N_{dmxCh}=f(\text{bitrate},N).$$

The downmix coefficents in D determine the mixing of the input signals (channels and objects). Depending on the application, the structure of the matrix D can be specified such that the channels and objects are mixed together or kept separated.

Some embodiments, are based on the finding that it is beneficial not to mix the objects together with the channels. To not mix the objects together with the channels, the downmix matrix may, e.g., be constructed as:

$$D=\begin{bmatrix} D_{ch} & 0 \\ 0 & D_{obj} \end{bmatrix}$$

In order to signal the separate mixing into the bitstream the values of the number of downmix channels assigned to the channel path ($N_{DmxCh}{}^{ch}$) and the number of downmix channels assigned to the object path ($N_{DmxCh}{}^{obj}$) may, e.g., be transmitted.

The block-wise downmixing matrices $D_{ch}$ and $D_{obj}$ have the sizes: $N_{DmxCh}\times N_{Channels}$ and respectively $N_{DmxCh}{}^{obj}\times N_{Objects}$.

At the decoder the coefficients of the parametric source estimation matrix $G\approx E_X D^H (D E_X D^H)^{-1}$ are computed in a different fashion. Using a matrix form, this can be expressed as:

$$G=\begin{bmatrix} G_{ch} & 0 \\ 0 & G_{obj} \end{bmatrix}$$

with:

$G_{ch}\approx E_X{}^{ch}D_{ch}{}^H(D_{ch}E_X{}^{ch}D_{ch}{}^H)^{-1}$ of size $N_{Channels}\times N_{DmxCh}{}^{ch}$ $G_{obj}\approx E_X{}^{obj}D_{obj}{}^H(D_{obj}E_X{}^{obj}D_{obj}{}^H)^{-1}$ of size $N_{Objects}\times N_{DmxCh}{}^{obj}$ The values of the channels signal covariance ($E_X^{ch}$) and object signal covariance (EP) may, e.g., be obtained from the input signals covariance matrix ($E_X$) by selecting only the corresponding diagonal blocks:

$$E_X = \begin{bmatrix} E_X^{ch} & E_X^{ch,obj} \\ E_X^{obj,ch} & E_X^{obj} \end{bmatrix}$$

As a direct consequence the bitrate is reduced by not sending the additional information (e.g., OLDs, IOCs) to reconstruct the cross-covariance matrix between channels and objects: $E_X^{ch,\,obj}=(E_X^{obj,ch})^H$.

According to some embodiments, $E_X^{ch,\,obj}=(E_X^{obj,\,ch})^H=0$, and thus:

$$E_X = \begin{bmatrix} E_X^{ch} & 0 \\ 0 & E_X^{obj} \end{bmatrix}.$$

According to an embodiment, the enhanced SAOC encoder is configured to not transmit information on a covariance between any one of the audio objects and any one of the audio channels to the enhanced SAOC decoder.

Moreover, according to an embodiment, the enhanced SAOC decoder is configured to not receive information on a covariance between any one of the audio objects and any one of the audio channels.

The off-diagonal block-wise elements of G are not computed, but set to zero. Therefore possible cross-talk between reconstructed channels and objects is avoided. Moreover, by this, reduction of computational complexity is achieved as less coefficients of G have to be computed.

Moreover, according to embodiments, instead of inverting the larger matrix:

$$DE_XD^H \text{ of size } [N_{Dmxch}{}^{ch}++H_{Dmxch}{}^{obj}]\times[N_{Dmxch}{}^{ch}+N_{DmxCh}{}^{obj}].$$

the two following small matrices are inverted:

$$D_{ch}E_X{}^{ch}D^H \text{ of size } N_{Dmxch}{}^{ch}\times H_{Dmxch}{}^{ch}$$

$$D_{obj}E_X{}^{obj}D^H \text{ of size } N_{Dmxch}{}^{obj}\times H_{Dmxch}{}^{obj}$$

Inverting the smaller matrices $D_{ch}E_X{}^{ch}D_{ch}{}^H$ and $D_{obj}E_X{}^{obj}D_{obj}{}^H$ is much cheaper regarding computational complexity than inverting the larger matrix $D\,E_X\,D^H$.

Furthermore, by inverting separate matrices $D_{ch}E_X{}^{ch}D_{ch}{}^H$ and $D_{obj}E_X{}^{obj}D_{obj}{}^H$, possible numerical instabilities are reduced compared to inverting the larger matrix $D\,E_X\,D^H$. For example, in the worst case scenario, when the covariance matrices of the transport channels $D_{ch}E_X{}^{ch}D_{ch}{}^H$ and $D_{obj}E_X{}^{obj}D_{obj}{}^H$ have linear dependencies due to signal similarities, the full matrix $D\,E_X\,D^H$ may be ill-conditioned while the separate smaller matrices can be well-conditioned.

After $$G = \begin{bmatrix} G_{ch} & 0 \\ 0 & G_{obj} \end{bmatrix}$$

is computed at the decoder side, then it is possible to, for example, parametrically estimate the input signals to obtain reconstructed input signals $\hat{X}$ (the input audio channel signals and the input audio object signals), e.g., using:

$$\hat{X}=GY.$$

Moreover, as described above, rendering may be conducted on the decoder side to obtain the output channels Z, e.g., by employing a rendering matrix R:

$$Z=R\hat{X}$$

$$Z=RGY$$

$$Z=SY; \text{ with } S=RG$$

Instead of explicitly reconstructing the input signals (the input audio channel signals and the input audio object signals) to obtain reconstructed input channels $\hat{X}$, the output channels Z may be directly generated at the decoder side by applying the output channel generation matrix S on the downmix audio signal Y.

As already described above, to obtain the output channel generation matrix S, rendering matrix R may, e.g., be determined or may, e.g., be already available. Furthermore, the parametric source estimation matrix G may, e.g., be computed as described above. The output channel generation matrix S may then be obtained as the matrix product S=RG from the rendering matrix R and the parametric source estimation matrix G.

Regarding the reconstructed audio object signals, compress metadata on the audio objects that is transmitted from the encoder to the decoder may be taken into account. For example, the metadata on the audio objects may indicate position information on each of the audio objects. Such position information may for example be an azimuth angle, an elevation angle and a radius. This position information may indicate a position of the audio object in a 3D space. For example, when an audio object is located close to an assumed or real loudspeaker position, such an audio object has a higher weight in the output channel for said loudspeaker compared to the weight of another audio object in the output channel being located far away from said loudspeaker. For example, vector base amplitude panning (VBAP) may be employed (see, for example, [VBAP]) to determine the rendering coefficients of the rendering matrix R for the audio objects.

Furthermore, in some embodiments, the compress metadata may comprise a gain value for each of the audio objects. For example, for each of the audio object signal, a gain value may indicate a gain factor for said audio object signal.

In contrast to the audio objects, no position information metadata is transmitted from the encoder to the decoder for the audio channel signals. A additional matrix (e.g., to convert 22.2 to 5.1) or identity matrix (when input configuration of the channels equals the output configuration) may, for example, be employed to determine the rendering coefficients of the rendering matrix R for the audio channels.

Rendering matrix R may be of size $N_{OutputChannels}\times N$. Here, for each of the output channels, a row exists in the matrix R. Moreover, in each row of the rendering matrix R, N coefficients determine the weight of the N input signals (the input audio channels and the input audio objects) in the corresponding output channel. Those audio objects being located close to the loudspeaker of said output channel have a greater coefficient than the coefficient of the audio objects being located far away from the loudspeaker of the corresponding output channel.

For example, Vector Base Amplitude Panning (VBAP) may be employed (see, e.g., [VBAP]) to determine the weight of an audio object signal within each of the audio channels of the loudspeakers. E.g., with respect to VBAP, it is assumed that an audio object relates to a virtual source.

As, in contrast to audio objects, audio channels do not have a position, the coefficients relating to audio channels in the rendering matrix may, e.g., be independent from position information.

In the following, the bitstream syntax according to embodiments is described.

In context of MPEG SAOC, signaling of the possible modes of operation (channel based, object based or combined mode) can be accomplished by using, for example, one of the two following possibilities (first possibility: using flags for signaling the operation mode; second possibility: without using flags for signaling the operation mode):

Thus, according to a first embodiment, flags are used for signaling the operation mode.

To use flags for signaling the operation mode a syntax of a SAOCSpecifigConfig( ) element or SAOC3DSpecifigConfig( ) element may, for example, comprise:

```
bsSaocChannelFlag;                                  1     uimsbf
NumInputSignals = 0;
bsSaocCombinedModeFlag = 0;
if (bsSaocChannelFlag) {
    bsNumSaocChannels;                              5     uimsbf
    bsNumSaocDmxChannels;                           5     uimsbf
    NumInputSignals += bsNumSaocChannels + 1;
}
bsSaocObjectFlag;                                   1     uimsbf
if (bsSaocObjectFlag) {
    bsNumSaocObjects;                               7     uimsbf
    bsNumSaocDmxObjects;                            5     uimsbf
    bsSaocCombinedModeFlag;                         1
    uimsbfNumInputSignals += bsNumSaocObjects + 1;
}
for ( i=0; i< bsNumSaocChannels+1; i++ ) {
    bsRelatedTo[i][i] = 1;
    for( j=i+1; j< bsNumSaocChannels+1; j++ ) {
        bsRelatedTo[i][j];                          1     uimsbf
        bsRelatedTo[j][i] = bsRelatedTo[i][j];
    }
}
for ( i= bsNumSaocChannels+1; i< bs NumInputSignals; i++ ) {
    for( j=0; j< bsNumSaocChannels+1; j++ ) {
        bsRelatedTo[i][j] = 0
        bsRelatedTo[j][i] = 0
    }
}
for ( i= bsNumSaocChannels+1; i< bs NumInputSignals; i++ ) {
    bsRelatedTo[i][i] = 1;
    for( j=i+1; j< NumInputSignals; j++ ) {
        bsRelatedTo[i][j];                          1     uimsbf
        bsRelatedTo[j][i] = bsRelatedTo[i][j];
    }
}
```

If the bitstream variable bsSaocChannelFlag is set to one the first bsNumSaocChannels+1 input signals are treated like channel based signals. If the bitstream variable bsSaocObjectFlag is set to one the last bsNumSaocObjects+1 input signals are processed like object signals. Therefore in case that both bitstream variables (bsSaocChannelFlag, bsSaocObjectFlag) are different than zero the presence of channels and objects into the audio transport channels is signaled.

If the bitstream variable bsSaocCombinedModeFlag is equal to one the combined decoding mode is signaled into the bitstream and, the decoder will process the bsNumSaocDmxChannels transport channels using the full downmix matrix D (this meaning that the channel signals and object signals are mixed together).

If the bitstream variable bsSaocCombinedModeFlag is zero the independent decoding mode is signaled and the decoder will process (bsNumSaocDmxChannels+1)+(bsNumSaocDmxObjects+1) transport channels using a blockwise downmix matrix as described above.

According to an advantageous second embodiment, no flags are needed for signaling the operation mode.

Signaling the operation mode without using flags, may, for example, be realized by employing the following syntax Signaling:

```
Syntax of SAOC3DSpecificConfig( ):

bsNumSaocDmxChannels;                               5     uimsbf
bsNumSaocDmxObjects;                                5     uimsbf
NumInputSignals = 0;
if (bsNumSaocDmxChannels > 0) {
    bsNumSaocChannels;                              6     uimsbf
    bsNumSaocLFEs;                                  2     uimsbf
    NumInputSignals += bsNumSaocChannels;
}
bsNumSaocObjects;                                   8     uimsbf
NumInputSignals += bsNumSaocObjects;
```

Restrict the cross-correlation between channels and objects to be zero:

```
for ( i=0; i<bsNumSaocChannels; i++ ) {
    bsRelatedTo[i][i] = 1;
    for( j=i+1; j< bsNumSaocChannels; j++ ) {
        bsRelatedTo[i][j];                          1     uimsbf
        bsRelatedTo[j][i] = bsRelatedTo[i][j];
    }
}
for ( i=bsNumSaocChannels; i<NumInputSignals; i++ ) {
    for( j=0; j<bsNumSaocChannels; j++ ) {
        bsRelatedTo[i][j] = 0;
        bsRelatedTo[j][i] = 0;
    }
}
for ( i=bsNumSaocChannels; i<NumInputSignals; i++ ) {
    bsRelatedTo[i][i] = 1;
    for( j=i+1; j<NumInputSignals; j++ ) {
        bsRelatedTo[i][j];                          1     uimsbf
        bsRelatedTo[j][i] = bsRelatedTo[i][j];
    }
}
```

Read the downmixing gains differently for the case when the audio channels and audio objects are mixed in different audio transport channels and when they are mixed together within the audio transport channels:

```
if (bsNumSaocDmxObjects==0) {
    for( i=0; i< bsNumSaocDmxChannels; i++ ) {
        idxDMG[i] = EcDataSaoc(DMG, 0, NumInputSignals);
    }
} else {
    dmgIdx = 0;
    for( i=0; i<bsNumSaocDmxChannels; i++ ) {
        idxDMG[i] = EcDataSaoc(DMG, 0, bsNumSaocChannels);
    }
    dmgIdx = bsNumSaocDmxChannels;
    if (bsSaocDmxMethod == 0) {
        for( i=dmgIdx; i<dmgIdx + bsNumSaocDmxObjects; i++ ) {
            idxDMG[i] = EcDataSaoc(DMG, 0,
            bsNumSaocObjects);
        }
    }
    if (bsSaocDmxMethod == 1) {
        for( i= dmgIdx; i<dmgIdx + bsNumSaocDmxObjects; i++ ) {
            idxDMG[i] = EcDataSaoc(DMG, 0,
            bsNumPremixedChannels);
        }
    }
}
```

If the bitstream variable bsNumSaocChannels is different than zero the first bsNumSaocChannels input signals are treated like channel based signals. If the bitstream variable bsNumSaocObjects is different than zero the last bsNumSaocObjects input signals are processed like object signals. Therefore in case that both bitstream variables are different than zero the presence of channels and objects into the audio transport channels is signaled.

If the bitstream variable bsNumSaocDmxObjects is equal to zero the combined decoding mode is signaled into the bitstream and, the decoder will process the bsNumSaocDmxChannels transport channels using the full downmix matrix D (this meaning that the channel signals and object signals are mixed together).

If the bitstream variable bsNumSaocDmxObjects is different than zero the independent decoding mode is signaled and the decoder will process bsNumSaocDmxChannels+bsNumSaocDmxObjects transport channels using a blockwise downmix matrix as described above.

In the following, aspects of downmix processing according to an embodiment are described:

The output signal of the downmix processor (represented in the hybrid QMF domain) is fed into the corresponding synthesis filterbank as described in ISO/IEC 23003-1:2007 yielding the final output of the SAOC 3D decoder.

The parameter processor 110 of FIG. 1 and the downmix processor 120 of FIG. 1 may be implemented as a joint processing unit. Such a joint processing unit is illustrated by FIG. 1, wherein units U and R implement the parameter processor 110 by providing the mixing information.

The output signal $\hat{Y}$ is computed from the multi-channel downmix signal X and the decorrelated multi-channel signal $X_d$ as:

$$\hat{Y}=P_{dry}RUX+P_{wet}M_{post}X_d,$$

where U represents the parametric unmixing matrix.

The mixing matrix $P=(P_{dry}, P_{wet})$ is a mixing matrix.

The decorrelated multi-channel signal $X_d$ is defined as $$X_d=decorrFunc(M_{pre}Y_{dry}).$$

The decoding mode is controlled by the bitstream element bsNumSaocDmxObjects:

| bsNumSaocDmxObjects | Decoding Mode | Meaning |
|---|---|---|
| 0 | Combined | The input channel based signals and the input object based signals are downmixed together into $N_{ch}$ channels. |
| >=1 | Independent | The input channel based signals are downmixed into $N_{ch}$ channels. The input object based signals are downmixed into $N_{obj}$ channels. |

In case of combined decoding mode the parametric unmixing matrix U is given by:

$$U=ED^*J.$$

The matrix J of size $N_{dmx}\times N_{dmx}$ is given by $J\approx\Delta^{-1}$ with $\Delta=DED^*$.

In case of independent decoding mode the unmixing matrix U is given by:

$$U=\begin{pmatrix} U_{ch} & 0 \\ 0 & U_{obj} \end{pmatrix},$$

where $U_{ch}=E_{ch}D_{ch}^*J_{ch}$ and $U_{obj}=E_{obj}D_{obj}^*J_{obj}$.

The channel based covariance matrix $E_{ch}$ of size $N_{ch}\times N_{ch}$ and the object based covariance matrix $E_{obj}$ of size $N_{obj}\times N_{obj}$ are obtained from the covariance matrix E by selecting only the corresponding diagonal blocks:

$$E=\begin{pmatrix} E_{ch} & E_{ch,obj} \\ E_{obj,ch} & E_{obj} \end{pmatrix},$$

where the matrix $E_{ch,obj}=(E_{obj,ch})^*$ represents the cross-covariance matrix between the input channels and input objects and need not be calculated.

The channel based downmix matrix $D_{ch}$ of size $N_{ch}^{dmx}\times N_{ch}$ and the object based downmix matrix $D_{obj}$ of size $N_{obj}^{dmx}\times N_{obj}$ are obtained from the downmix matrix D by selecting only the corresponding diagonal blocks:

$$D=\begin{pmatrix} D_{ch} & 0 \\ 0 & D_{obj} \end{pmatrix}.$$

The matrix $J_{ch}\approx(D_{ch}E_{ch}D_{ch}^*)^{-1}$ of size $N_{ch}^{dmx}\times N_{ch}^{dmx}$ is derived from the definition of matrix J for $$\Delta=D_{ch}E_{ch}D_{ch}^*.$$

The matrix $J_{obj}\approx(D_{obj}E_{obj}D_{obj}^*)^{-1}$ of size $N_{obj}^{dmx}\times N_{obj}^{dmx}$ is derived from the definition of matrix J for $$\Delta=D_{obj}E_{obj}D_{obj}^*$$

The matrix $J\approx\Delta^{-1}$ is calculated using the following equation:

$$J=V\Lambda^{inv}V^*.$$

Here the singular vectors V of the matrix Δ are obtained using the following characteristic equation $$V\Lambda V^*=\Delta.$$

The regularized inverse $\Lambda^{inv}$ of the diagonal singular value matrix Λ is computed as $$\lambda_{i,j}^{inv}=\begin{cases} \frac{1}{\lambda_{i,j}}, & \text{if } i=j \text{ and } \lambda_{i,j}\geq T_{reg}^{\Lambda} \\ 0, & \text{otherwise} \end{cases},$$

The relative regularization scalar $T_{reg}^{\Lambda}$ is determined using absolute threshold $T_{reg}$ and maximal value of Λ as $$T_{reg}^{\Lambda}=\max(\lambda_{i,i})T_{reg}, T_{reg}=10^{-2}.$$

In the following, the rendering matrix according to an embodiment is described:

The rendering matrix R applied to the input audio signals S determines the target rendered output as Y=RS. The rendering matrix R of size $N_{out}\times N$ is given by $$R=(R_{ch}R_{obj}),$$

where $R_{ch}$ of size $N_{out}\times N_{ch}$ represents the rendering matrix associated with the input channels and $R_{obj}$ of size $N_{out}\times N_{obj}$ represents the rendering matrix associated with the input objects.

In the following, decorrelated multi-channel signal $X_d$ according to an embodiment is described:

The decorrelated signals $X_d$ are, for example, created from the decorrelator described in 6.6.2 of ISO/IEC 23003-

1:2007, with bsDecorrConfig==0 and, e.g., a decorrelator index, X. Hence, the decorrFunc( ) for example, denotes the decorrelation process:

$$X_d = \text{decorrFunc}(M_{pre} Y_{dry}).$$

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

The inventive decomposed signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a non-transitory data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

REFERENCES

[SAOC1] J. Herre, S. Disch, J. Hilpert, O. Hellmuth: "From SAC To SAOC—Recent Developments in Parametric Coding of Spatial Audio", 22nd Regional UK AES Conference, Cambridge, UK, April 2007.

[SAOC2] J. Engdegard, B. Resch, C. Falch, O. Hellmuth, J. Hilpert, A. Hölzer, L. Terentiev, J. Breebaart, J. Koppens, E. Schuijers and W. Oomen: "Spatial Audio Object Coding (SAOC)—The Upcoming MPEG Standard on Parametric Object Based Audio Coding", 124th AES Convention, Amsterdam 2008.

[SAOC] ISO/IEC, "MPEG audio technologies—Part 2: Spatial Audio Object Coding (SAOC)," ISO/IEC JTC1/SC29/WG11 (MPEG) International Standard 23003-2.

[VBAP] Ville Pulkki, "Virtual Sound Source Positioning Using Vector Base Amplitude Panning"; J. Audio Eng. Soc., Level 45, Issue 6, pp. 456-466, June 1997.

[M1] Peters, N., Lossius, T. and Schacher J. C., "SpatDIF: Principles, Specification, and Examples", 9th Sound and Music Computing Conference, Copenhagen, Denmark, July 2012.

[M2] Wright, M., Freed, A., "Open Sound Control: A New Protocol for Communicating with Sound Synthesizers", International Computer Music Conference, Thessaloniki, Greece, 1997.

[M3] Matthias Geier, Jens Ahrens, and Sascha Spors. (2010), "Object-based audio reproduction and the audio scene description format", Org. Sound, Vol. 15, No. 3, pp. 219-227, December 2010.

[M4] W3C, "Synchronized Multimedia Integration Language (SMIL 3.0)", December 2008.

[M5] W3C, "Extensible Markup Language (XML) 1.0 (Fifth Edition)", November 2008.

[M6] MPEG, "ISO/IEC International Standard 14496-3—Coding of audio-visual objects, Part 3 Audio", 2009.

[M7] Schmidt, J.; Schroeder, E. F. (2004), "New and Advanced Features for Audio Presentation in the MPEG-4 Standard", 116th AES Convention, Berlin, Germany, May 2004.

[M8] Web3D, "International Standard ISO/IEC 14772-1: 1997—The Virtual Reality Modeling Language (VRML), Part 1: Functional specification and UTF-8 encoding", 1997.

[M9] Sporer, T. (2012), "Codierung räumlicher Audiosignale mit leichtgewichtigen Audio-Objekten", Proc. Annual Meeting of the German Audiological Society (DGA), Erlangen, Germany, March 2012.

The invention claimed is:

1. An apparatus for generating one or more audio output channels, wherein the apparatus comprises:

a parameter processor for calculating mixing information, and a downmix processor for generating the one or more audio output channels, wherein the downmix processor is configured to receive a data stream comprising audio transport channels of an audio transport signal, wherein one or more audio channel signals are mixed within the audio transport signal, wherein one or more audio object signals are mixed within the audio transport signal, and wherein the number of the audio transport channels is smaller than the number of the one or more audio channel signals plus the number of the one or more audio object signals, wherein the parameter processor is configured to receive downmix information indicating information on how the one or more audio channel signals and the one or more audio object signals are mixed within the audio transport channels, and wherein the parameter processor is configured to receive covariance information, and wherein the parameter processor is configured to calculate the mixing information depending on the downmix information and depending on the covariance information, and wherein the downmix processor is configured to generate the one or more audio output channels from the audio transport signal depending on the mixing information, wherein the covariance information indicates a level difference information for at least one of the one or more audio channel signals and further indicates a level difference information for at least one of the one or more audio object signals, and wherein the covariance information does not indicate correlation information for any pair of one of the one or more audio channel signals and one of the one or more audio object signals, wherein the one or more audio channel signals are mixed within a first group of one or more of the audio transport channels, wherein the one or more audio object signals are mixed within a second group of one or more of the audio transport channels, wherein each audio transport channel of the first group is not comprised by the second group, and wherein each audio transport channel of the second group is not comprised by the first group, and wherein the downmix information comprises first downmix subinformation indicating information on how the one or more audio channel signals are mixed within the first group of the audio transport channels, and wherein the downmix information comprises second downmix subinformation indicating information on how the one or more audio object signals are mixed within the second group of the one or more audio transport channels, wherein the parameter processor is configured to calculate the mixing information depending on the first downmix subinformation, depending on the second downmix subinformation and depending on the covariance information, wherein the downmix processor is configured to generate the one or more audio output signals from the first group of audio transport channels and from the second group of audio transport channels depending on the mixing information, wherein the downmix processor is configured to receive a first channel count number indicating the number of the audio transport channels of the first group of audio transport channels, and wherein the downmix processor is configured to receive a second channel count number indicating the number of the audio transport channels of the second group of audio transport channels, and wherein the downmix processor is configured to identify whether an audio transport channel within the data stream belongs to the first group or to the second group depending on the first channel count number or depending on the second channel count number, or depending on the first channel count number and the second channel count number.

2. An apparatus according to claim 1, wherein the covariance information indicates a level difference information for each of the one or more audio channel signals and further indicates a level difference information for each of the one or more audio object signals.

3. An apparatus according to claim 1, wherein two or more audio object signals are mixed within the audio transport signal, and wherein two or more audio channel signals are mixed within the audio transport signal, wherein the covariance information indicates correlation information for one or more pairs of a first one of the two or more audio channel signals and a second one of the two or more audio channel signals, or wherein the covariance information indicates correlation information for one or more pairs of a first one of the two or more audio object signals and a second one of the two or more audio object signals, or wherein the covariance information indicates correlation information for one or more pairs of a first one of the two or more audio channel signals and a second one of the two or more audio channel signals and indicates correlation information for one or more pairs of a first one of the two or more audio object signals and a second one of the two or more audio object signals.

4. An apparatus according to claim 1, wherein the covariance information comprises a plurality of covariance coefficients of a covariance matrix $E_X$ of size N×N, wherein N indicates the number of the one or more audio channel signals plus the number of the one or more audio object signals, wherein the covariance matrix $E_X$ is defined according to the formula $$E_X = \begin{bmatrix} E_X^{ch} & 0 \\ 0 & E_X^{obj} \end{bmatrix},$$

wherein $E_X^{ch}$ indicates the coefficients of a first covariance submatrix of size $N_{Channels} \times N_{Channels}$, wherein $N_{Channels}$ indicates the number of the one or more audio channel signals, wherein $E_X^{obj}$ indicates the coefficients of a second covariance submatrix of size $N_{Objects} \times N_{Objects}$, wherein $N_{Objects}$ indicates the number of the one or more audio object signals, wherein 0 indicates a zero matrix, wherein the parameter processor is configured to receive the plurality of covariance coefficients of the covariance matrix $E_X$, and wherein the parameter processor is configured to set all coefficients of the covariance matrix $E_X$ to 0, that are not received by the parameter processor.

5. An apparatus according to claim 1, wherein the downmix information comprises a plurality of downmix coefficients of a downmix matrix D of size $N_{DmxCh} \times N$, wherein $N_{DmxCh}$ indicates the number of the audio transport channels, and wherein N indicates the number of the one or more audio channel signals plus the number of the one or more audio object signals, wherein the downmix matrix D is defined according to the formula $$D = \begin{bmatrix} D_{ch} & 0 \\ 0 & D_{obj} \end{bmatrix},$$

wherein $D_{ch}$ indicates the coefficients of a first downmix submatrix of size $N_{DmxCh}^{ch} \times N_{Channels}$, wherein indicates $N_{DmxCh}^{ch}$ the number of the audio transport channels of the first group of the audio transport channels, and wherein $N_{Channels}$ indicates the number of the one or more audio channel signals, wherein $D_{obj}$ indicates the coefficients of a second downmix submatrix of size $N_{DmxCh}^{obj} \times N_{Objects}$, wherein indicates $N_{DmxCh}^{obj}$ the number of the audio transport channels of the second group of the audio transport channels, and wherein $N_{Objects}$ indicates the number of the one or more audio channel signals, wherein 0 indicates a zero matrix, wherein the parameter processor is configured to receive the plurality of downmix coefficients of the downmix matrix D, and wherein the parameter processor is configured to set all coefficients of the downmix matrix D to 0, that are not received by the parameter processor.

6. An apparatus according to claim 1, wherein the parameter processor is configured to receive rendering information indicating information on how the one or more audio channel signals and the one or more audio object signals are mixed within the one or more audio output channels, wherein the parameter processor is configured to calculate the mixing information depending on the downmix information, depending on the covariance information and depending on rendering information.

7. An apparatus according to claim 6, wherein the parameter processor is configured to receive a plurality of coefficients of a rendering matrix R as the rendering information, and wherein the parameter processor is configured to calculate the mixing information depending on the downmix information, depending on the covariance information and depending on the rendering matrix R.

8. An apparatus according to claim 6, wherein the parameter processor is configured to receive metadata information as the rendering information, wherein the metadata information comprises position information, wherein the position information indicates a position for each of the one or more audio object signals, wherein the position information does not indicate a position for any of the one or more audio channel signals, wherein the parameter processor is configured to calculate the mixing information depending on the downmix information, depending on the covariance information, and depending on the position information.

9. An apparatus according to claim 8, wherein the metadata information further comprises gain information, wherein the gain information indicates a gain value for each of the one or more audio object signals, wherein the gain information does not indicate a gain value for any of the one or more audio channel signals, wherein the parameter processor is configured to calculate the mixing information depending on the downmix information, depending on the covariance information, depending on the position information, and depending on the gain information.

10. An apparatus according to claim 8, wherein the parameter processor is configured to calculate a mixing matrix S as the mixing information, wherein the mixing matrix S is defined according to the formula $$S=RG,$$

wherein G is a decoding matrix depending on the downmix information and depending on the covariance information, wherein R is a rendering matrix depending on the metadata information, wherein the downmix processor is configured to generate the one or more audio output channels of the audio output signal by applying the formula $$Z=SY,$$

wherein Z is the audio output signal, and wherein Y is the audio transport signal.

11. An apparatus according to claim 1, wherein two or more audio object signals are mixed within the audio transport signal, and wherein two or more audio channel signals are mixed within the audio transport signal, wherein the covariance information indicates correlation information for one or more pairs of a first one of the two or more audio channel signals and a second one of the two or more audio channel signals, wherein the covariance information does not indicate correlation information for any pair of a first one of the one or more audio object signals and a second one of the one or more audio object signals, and wherein the parameter processor is configured to calculate the mixing information depending on the downmix information, depending on a the level difference information of each of the one or more audio channel signals, depending on the second level difference information of each of the one or more audio object signals, and depending on the correlation information of the one or more pairs of a first one of the two or more audio channel signals and a second one of the two or more audio channel signals.

12. An apparatus for generating an audio transport signal comprising audio transport channels, wherein the apparatus comprises:

a channel/object mixer for generating the audio transport channels of the audio transport signal, and an output interface, wherein the channel/object mixer is configured to generate the audio transport signal comprising the audio transport channels by mixing one or more audio channel signals and one or more audio object signals within the audio transport signal depending on downmix information indicating information on how the one or more audio channel signals and the one or more audio object signals have to be mixed within the audio transport channels, wherein the number of the audio transport channels is smaller than the number of the one or more audio channel signals plus the number of the one or more audio object signals, wherein the output interface is configured to output the audio transport signal, the downmix information and covariance information, wherein the covariance information indicates a level difference information for at least one of the one or more audio channel signals and further indicates a level difference information for at least one of the one or more audio object signals, and wherein the covariance information does not indicate correlation information for any pair of one of the one or more audio channel signals and one of the one or more audio object signals, wherein the apparatus is configured to mix the one or more audio channel signals within a first group of one or more of the audio transport channels, wherein the apparatus is configured to mix the one or more audio object signals within a second group of one or more of the audio transport channels, wherein each audio transport channel of the first group is not comprised by the second group, and wherein each audio transport channel of the second group is not comprised by the first group, and wherein the downmix information comprises first downmix subinformation indicating information on how the one or more audio channel signals are mixed within the first group of the audio transport channels, and wherein the downmix information comprises second downmix subinformation indicating information on how the one or more audio object signals are mixed within the second group of the audio transport channels, wherein the apparatus is configured to output a first channel count number indicating the number of the audio transport channels of the first group of audio transport channels, and wherein the apparatus is configured to output a second channel count number indicating the number of the audio transport channels of the second group of audio transport channels.

13. An apparatus according to claim 12, wherein channel/object mixer is configured to generate the audio transport signal so that the number of the audio transport channels of the audio transport signal depends on how much bitrate is available for transmitting the audio transport signal.

14. A system, comprising:

an apparatus for generating an audio transport signal comprising audio transport channels, wherein the apparatus comprises:

a channel/object mixer for generating the audio transport channels of the audio transport signal, and an output interface, wherein the channel/object mixer is configured to generate the audio transport signal comprising the audio transport channels by mixing one or more audio channel signals and one or more audio object signals within the audio transport signal depending on downmix information indicating information on how the one or more audio channel signals and the one or more audio object signals have to be mixed within the audio transport channels, wherein the number of the audio transport channels is smaller than the number of the one or more audio channel signals plus the number of the one or more audio object signals, wherein the output interface is configured to output the audio transport signal, the downmix information and covariance information, wherein the covariance information indicates a level difference information for at least one of the one or more audio channel signals and further indicates a level difference information for at least one of the one or more audio object signals, and wherein the covariance information does not indicate correlation information for any pair of one of the one or more audio channel signals and one of the one or more audio object signals, wherein the apparatus is configured to mix the one or more audio channel signals within a first group of one or more of the audio transport channels, wherein the apparatus is configured to mix the one or more audio object signals within a second group of one or more of the audio transport channels, wherein each audio transport channel of the first group is not comprised by the second group, and wherein each audio transport channel of the second group is not comprised by the first group, and wherein the downmix information comprises first downmix subinformation indicating information on how the one or more audio channel signals are mixed within the first group of the audio transport channels, and wherein the downmix information comprises second downmix subinformation indicating information on how the one or more audio object signals are mixed within the second group of the audio transport channels, wherein the apparatus is configured to output a first channel count number indicating the number of the audio transport channels of the first group of audio transport channels, and wherein the apparatus is configured to output a second channel count number indicating the number of the audio transport channels of the second group of audio transport channels, and an apparatus for generating one or more audio output channels, wherein the apparatus comprises:

a parameter processor for calculating mixing information, and a downmix processor for generating the one or more audio output channels, wherein the downmix processor is configured to receive a data stream comprising audio transport channels of an audio transport signal, wherein one or more audio channel signals are mixed within the audio transport signal, wherein one or more audio object signals are mixed within the audio transport signal, and wherein the number of the audio transport channels is smaller than the number of the one or more audio channel signals plus the number of the one or more audio object signals, wherein the parameter processor is configured to receive downmix information indicating information on how the one or more audio channel signals and the one or more audio object signals are mixed within the audio transport channels, and wherein the parameter processor is configured to receive covariance information, and wherein the parameter processor is configured to calculate the mixing information depending on the downmix information and depending on the covariance information, and wherein the downmix processor is configured to generate the one or more audio output channels from the audio transport signal depending on the mixing information, wherein the covariance information indicates a level difference information for at least one of the one or more audio channel signals and further indicates a level difference information for at least one of the one or more audio object signals, and wherein the covariance information does not indicate correlation information for any pair of one of the one or more audio channel signals and one of the one or more audio object signals, wherein the one or more audio channel signals are mixed within a first group of one or more of the audio transport channels, wherein the one or more audio object signals are mixed within a second group of one or more of the audio transport channels, wherein each audio transport channel of the first group is not comprised by the second group, and wherein each audio transport channel of the second group is not comprised by the first group, and wherein the downmix information comprises first downmix subinformation indicating information on how the one or more audio channel signals are mixed within the first group of the audio transport channels, and wherein the downmix information comprises second downmix subinformation indicating information on how the one or more audio object signals are mixed within the second group of the one or more audio transport channels, wherein the parameter processor is configured to calculate the mixing information depending on the first downmix subinformation, depending on the second downmix subinformation and depending on the covariance information, wherein the downmix processor is configured to generate the one or more audio output signals from the first group of audio transport channels and from the second group of audio transport channels depending on the mixing information, wherein the downmix processor is configured to receive a first channel count number indicating the number of the audio transport channels of the first group of audio transport channels, and wherein the downmix processor is configured to receive a second channel count number indicating the number of the audio transport channels of the second group of audio transport channels, and wherein the downmix processor is configured to identify whether an audio transport channel within the data stream belongs to the first group or to the second group depending on the first channel count number or depending on the second channel count number, or depending on the first channel count number and the second channel count number, wherein the apparatus for generating one or more audio output channels is configured to receive the audio transport signal, downmix information and covariance information from the an apparatus for generating an audio transport signal, and wherein the apparatus for generating one or more audio output channels is configured to generate the one or more audio output channels from the audio transport signal depending on the downmix information and depending on the covariance information.

15. A method for generating one or more audio output channels, wherein the method comprises:

receiving a data stream comprising audio transport channels of an audio transport signal, wherein one or more audio channel signals are mixed within the audio transport signal, wherein one or more audio object signals are mixed within the audio transport signal, and wherein the number of the audio transport channels is smaller than the number of the one or more audio channel signals plus the number of the one or more audio object signals, receiving downmix information indicating information on how the one or more audio channel signals and the one or more audio object signals are mixed within the audio transport channels, receiving covariance information, calculating mixing information depending on the downmix information and depending on the covariance information, and generating the one or more audio output channels, generating the one or more audio output channels from the audio transport signal depending on the mixing information, wherein the covariance information indicates a level difference information for at least one of the one or more audio channel signals and further indicates a level difference information for at least one of the one or more audio object signals, and wherein the covariance information does not indicate correlation information for any pair of one of the one or more audio channel signals and one of the one or more audio object signals, wherein the one or more audio channel signals are mixed within a first group of one or more of the audio transport channels, wherein the one or more audio object signals are mixed within a second group of one or more of the audio transport channels, wherein each audio transport channel of the first group is not comprised by the second group, and wherein each audio transport channel of the second group is not comprised by the first group, and wherein the downmix information comprises first downmix subinformation indicating information on how the one or more audio channel signals are mixed within the first group of the audio transport channels, and wherein the downmix information comprises second downmix subinformation indicating information on how the one or more audio object signals are mixed within the second group of the audio transport channels, wherein the mixing information is calculated depending on the first downmix subinformation, depending on the second downmix subinformation and depending on the covariance information, wherein the one or more audio output signals are generated from the first group of audio transport channels and from the second group of audio transport channels depending on the mixing information, wherein the method further comprises receiving a first channel count number indicating the number of the audio transport channels of the first group of audio transport channels, and wherein the method further comprises receiving a second channel count number indicating the number of the audio transport channels of the second group of audio transport channels, and wherein the method further comprises identifying whether an audio transport channel within the data stream belongs to the first group or to the second group depending on the first channel count number or depending on the second channel count number, or depending on the first channel count number and the second channel count number.

16. A non-transitory digital storage medium having computer-readable code stored thereon to perform the method of claim 15 when said storage medium is run by a computer or signal processor.

17. A method for generating an audio transport signal comprising audio transport channels, wherein the method comprises:

generating the audio transport signal comprising the audio transport channels by mixing one or more audio channel signals and one or more audio object signals within the audio transport signal depending on downmix information indicating information on how the one or more audio channel signals and the one or more audio object signals have to be mixed within the audio transport channels, wherein the number of the audio transport channels is smaller than the number of the one or more audio channel signals plus the number of the one or more audio object signals, and outputting the audio transport signal, the downmix information and covariance information, wherein the covariance information indicates a level difference information for at least one of the one or more audio channel signals and further indicates a level difference information for at least one of the one or more audio object signals, and wherein the covariance information does not indicate correlation information for any pair of one of the one or more audio channel signals and one of the one or more audio object signals, wherein the one or more audio channel signals are mixed within a first group of one or more of the audio transport channels, wherein the one or more audio object signals are mixed within a second group of one or more of the audio transport channels, wherein each audio transport channel of the first group is not comprised by the second group, and wherein each audio transport channel of the second group is not comprised by the first group, and wherein the downmix information comprises first downmix subinformation indicating information on how the one or more audio channel signals are mixed within the first group of the audio transport channels, and wherein the downmix information comprises second downmix subinformation indicating information on how the one or more audio object signals are mixed within the second group of the audio transport channels, and wherein the method further comprises outputting a first channel count number indicating the number of the audio transport channels of the first group of audio transport channels, and wherein the method further comprises outputting a second channel count number indicating the number of the audio transport channels of the second group of audio transport channels.

18. A non-transitory digital storage medium having computer-readable code stored thereon to perform the method of claim 17 when said storage medium is run by a computer or signal processor.

* * * * *